US007076926B2

(12) United States Patent
Kasai et al.

(10) Patent No.: US 7,076,926 B2
(45) Date of Patent: Jul. 18, 2006

(54) DAMPING INTERMEDIATE PILLAR AND DAMPING STRUCTURE USING THE SAME

(75) Inventors: Kazuhiko Kasai, Unit 117, 33-12 Sakuradai, Aoba-ku, Yokohama-shi, Kanagawa 227-0061 (JP); Hiroshi Nakamura, Tokyo (JP); Yasuhiro Nakata, Tokyo (JP); Takashi Shirai, Tokyo (JP)

(73) Assignees: Kazuhiko Kasai, Yokohama (JP); Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/213,201

(22) Filed: Aug. 6, 2002

(65) Prior Publication Data

US 2004/0074161 A1 Apr. 22, 2004

(30) Foreign Application Priority Data

Aug. 7, 2001 (JP) ..... 2001-238654

(51) Int. Cl.
*E04H 9/02* (2006.01)
*E04B 1/98* (2006.01)

(52) U.S. Cl. ..... 52/167.8; 52/167.7; 52/167.1

(58) Field of Classification Search ..... 52/167.3, 52/393, 693, 656.1, 167.1, 167.4–167.9, 52/167.2, 394
See application file for complete search history.

(56) References Cited

U.S. PATENT DOCUMENTS 3,691,712 A * 9/1972 Bowling et al. ..... 52/393
3,793,790 A * 2/1974 Love et al. ..... 52/393
4,102,097 A * 7/1978 Zalotay ..... 52/167.4
4,209,868 A * 7/1980 Tada et al. ..... 14/73.5
4,441,289 A * 4/1984 Ikuo et al. ..... 52/167.1
4,499,694 A * 2/1985 Buckle et al. ..... 52/167.7
4,527,365 A * 7/1985 Yoshizawa et al. ..... 52/167.8
4,574,540 A * 3/1986 Shiau ..... 52/167.8
4,615,157 A * 10/1986 Murray ..... 52/167.4
4,718,206 A * 1/1988 Fyfe et al. ..... 52/167.8
4,766,708 A * 8/1988 Sing ..... 52/167.8
5,014,474 A * 5/1991 Fyfe et al. ..... 52/167.8
5,065,555 A * 11/1991 Kobori et al. ..... 52/167.7

(Continued)

FOREIGN PATENT DOCUMENTS

JP 10159379 A * 6/1998

(Continued)

*Primary Examiner*—Jeanette E. Chapman
(74) *Attorney, Agent, or Firm*—Kenyon & Kenyon LLP

(57) ABSTRACT

A damping intermediate pillar, which can exhibit a sufficient resistance against the horizontal force of a strong earthquake by reinforcing the joins between the damping intermediate pillar and the upper and lower beams, is disclosed. A damping intermediate pillar 14, used for a building or a structure configured of pillars 1 and beams 3, is divided into upper and lower damping intermediate pillar portions 14*a*, 14*b* of H shape steel, and includes a plurality of inner steel plates 7*b* fixed on the damping intermediate pillar portion 14*b* and a plurality of outer steel plates 7*a* fixed on the other damping intermediate pillar portion 14*a*. The inner and outer steel plates are arranged alternately in a single or a plurality of layers, between which a viscoelastic member 15 is held to make up a viscoelastic damper 17. The coupling end surfaces of the intermediate pillar portions 14*a*, 14*b* directed vertically are fixed on the upper and lower floor beams 3*a*, 3*b*. Further, one or both sides of each of the damping intermediate pillar portions 14*a*, 14*b* (i.e. the coupling members 13*a*, 13*b*) and the upper and lower floor beams 3*a*, 3*b* are coupled to each other by knee braces 19.

3 Claims, 23 Drawing Sheets

U.S. PATENT DOCUMENTS 5,090,166 A * 2/1992 Johnson et al. ..... 52/167.3
5,259,818 A * 11/1993 Kachi et al. ..... 464/89
5,349,794 A * 9/1994 Taga ..... 52/167.1
5,370,352 A * 12/1994 Platus ..... 248/619
5,491,938 A * 2/1996 Niwa et al. ..... 52/167.1
5,595,372 A * 1/1997 Patten ..... 267/64.13
5,630,298 A * 5/1997 Tsai et al. ..... 52/167.3
5,732,802 A * 3/1998 Tsukagoshi ..... 188/378
5,740,652 A * 4/1998 Inoue et al. ..... 52/745.1
5,791,097 A * 8/1998 Winston et al. ..... 52/167.1
5,819,484 A * 10/1998 Kar ..... 52/167.3
5,875,589 A * 3/1999 Lai et al. ..... 52/1
5,971,347 A * 10/1999 Tsai et al. ..... 248/618
6,037,403 A * 3/2000 Katase et al. ..... 524/579
6,115,972 A * 9/2000 Tamez ..... 52/167.4
6,141,919 A * 11/2000 Robinson ..... 52/167.7
6,354,047 B1 * 3/2002 Shimoda et al. ..... 52/167.1
6,457,284 B1 * 10/2002 Isoda ..... 52/167.1
6,543,077 B1 * 4/2003 Ouchi et al. ..... 14/77.1
6,601,350 B1 * 8/2003 Isoda ..... 52/167.1
6,681,536 B1 * 1/2004 Isoda ..... 52/167.8
6,840,017 B1 * 1/2005 Shimoda et al. ..... 52/167.1

FOREIGN PATENT DOCUMENTS

JP 2000-54680 2/2000
JP 2000-73605 3/2000
JP 2000-73608 3/2000
JP 2000-73609 3/2000
JP 2000-73610 3/2000
JP 2000-73611 3/2000
JP 2000-274108 10/2000
JP 2005090125 A * 4/2005
JP 2005090126 A * 4/2005

* cited by examiner

3(3a)
3(3b)
8
21
23
23a
23b
24
35
36
37
38
17
14
33
32(14b)
34(14a)
(D)

DAMPING INTERMEDIATE PILLAR AND DAMPING STRUCTURE USING THE SAME

BACKGROUND OF THE INVENTION

1. Field of the Invention

The present invention relates to a damping intermediate pillar and a damping structure using such a damping pillar intended to absorb an input vibration energy or, especially, a horizontal force in framed structures and various other structures of buildings.

2. Description of the Related Art

The conventional techniques in this category include the following (1) to (7):

(1) Japanese Unexamined Patent Publication No. 2000-274108 relating to a structure of a viscoelastic damper coupled directly to the beams of upper and lower floors, (2) Japanese Unexamined Patent Publication No. 2000-54680 relating to a detailed structure for installing a viscoelastic damper on the beams of upper and lower floors, (3) Japanese Unexamined Patent Publication No. 2000-73605 relating to the surface shape of a laminated steel plate for a viscoelastic damper, (4) Japanese Unexamined Patent Publication No. 2000-73608 relating to a technique for coupling a viscoelastic damper, (5) Japanese Unexamined Patent Publication No. 2000-73609 relating to a technique for coupling a viscoelastic damper, (6) Japanese Unexamined Patent Publication No. 2000-73610 relating to a technique for coupling a viscoelastic damper, and (7) Japanese Unexamined Patent Publication No. 2000-73611 relating to the reinforcement around a viscoelastic damper.

Of the conventional techniques described above, an explanation will be given of a case in which the horizontal vibrations acting on the beams of the upper and lower floors are attenuated by being transmitted to a viscoelastic damper through an intermediate pillar, with reference to FIGS. 23A and 23B. In FIGS. 23A and 23B, beams 3*a*, 3*b* of the upper and lower floors and pillars 1 are coupled to each other by pillar-beam joins 2, and the beams 3*a*, 3*b* of the upper and lower floors are coupled to each other by a damping intermediate pillar 4 having a viscoelastic damper 6 at an intermediate portion thereof, thereby making up a structural frame of a building.

Specifically, the damping intermediate pillar 4 is divided into upper and lower portions, i.e. an upper damping intermediate pillar portion 4*a* with the upper end thereof fixed to the beam 3*a* of the upper floor and a lower damping intermediate pillar portion 4*b* with the lower end thereof fixed to the beam 3*b* of the lower floor. Also, the upper and lower damping intermediate pillars portion 4*a*, 4*b* are fixed with inner and outer steel plates 5*a*, 5*b*, respectively, which are superposed one on the other in spaced parallel relation to each other. A tabular viscoelastic member 5 of a predetermined thickness is arranged in the space between the superposed parallel steel plates 5*a*, 5*b* for holding the upper and lower damping intermediate pillars 4*a*, 4*b*. The tabular viscoelastic member 5 is held and fixed by adhesive thereby to make up a viscoelastic damper 6.

Assume that the structural frame of a building having the damping intermediate pillar 4 described above vibrates in an earthquake and a horizontal force is applied to the beams 3*a*, 3*b* in the direction of arrow in FIG. 23B. The particular horizontal force is transmitted to the viscoelastic member 5 from the beams 3 through the upper and lower damping intermediate pillar portions 4*a*, 4*b*. The horizontal force is attenuated by the viscoelastic member 5, while the pillars 1, the upper and lower beams 3*a*, 3*b* and the damping intermediate pillar 4 are deformed as indicated by dotted lines in FIG. 23B. In this way, the vibration is attenuated gradually.

In the case where a structural frame of a building is designed with a viscoelastic damper built in an intermediate pillar, the horizontal force due to an earthquake of an assumed predetermined magnitude and the damping capacity of the building are determined by calculations. In a manner to meet this condition, a viscoelastic damper having an attenuation capacity of a predetermined value determined by the material, size and thickness (sectional area) of the viscoelastic member is fabricated and built in the intermediate pillar. The conventional join structure between the upper and lower end portions of the damping intermediate pillar and the upper and lower floor beams, however, poses the following problem as it lacks the strength of endurance of the join between the damping intermediate pillar 4 and the upper and lower floor beams 3*a*, 3*b* against the horizontal force which may be exerted by an earthquake.

Specifically, in FIG. 23B, the damping action of the viscoelastic damper 6 is transmitted from the damping intermediate pillar 4 via the beams 3*a*, 3*b* to the pillar-beam joins 2 to damp the vibration of the building. In view of the fact that the upper and lower end portions of the damping intermediate pillar 4 are fixedly coupled simply by bolts or welding to the beams 3*a*, 3*b* of the upper and lower floors, however, the join strength is not sufficient against an earthquake of a comparatively large magnitude. As a result, the joins 9*a* between the damping intermediate pillar 4 and the beams 3 are inconveniently liable be broken before the damping function is exhibited.

The object of the present invention is to provide a novel damping intermediate pillar and a damping structure employing such a damping intermediate pillar which solve the problem of the prior art described above.

SUMMARY OF THE INVENTION

The invention has been developed to solve the problem described above, and the gist thereof is as follows:

(1) A damping intermediate pillar for a structure having pillars and beams, comprising upper and lower damping intermediate pillar portions of H shape steel directed upward and downward, respectively, a plurality of inner steel plates fixed on one of the damping intermediate pillar portions, a plurality of outer steel plates fixed on the other damping intermediate pillar portion, the inner steel plates and the outer steel plates being arranged alternately with each other in a single layer or a plurality of layers, a viscoelastic member held between the inner and outer steel plates thereby to make up a vibration energy absorbing unit, a plurality of coupling members of H shape steel coupled to each of the upper and lower damping intermediate pillar portions directed upward and downward, respectively, the coupling members being fixed on the beams of the upper and lower floors, respectively, and a plurality of knee braces, wherein one or both sides of the upper and lower damping intermediate pillar portions or the coupling members of H shape steel are coupled to the upper and lower floor beams, respectively, by the knee braces.

(2) A damping intermediate pillar for a structure having pillars and beams, comprising upper and lower damping intermediate pillar portions of H shape steel directed upward and downward, respectively, the lower damping intermediate pillar portion making up a damping box containing a viscous material and having an upper opening, the upper damping intermediate pillar portion being formed of a steel member inserted into the viscous material of the damping box thereby to make up a vibration energy absorbing unit, a plurality of coupling members of H shape steel coupled to the upper and lower damping intermediate pillar portions directed upward and downward, respectively, the coupling members being fixed on the beams of the upper and lower floors, respectively, and a plurality of knee braces, wherein one or both sides of the upper and lower damping intermediate pillar portions or the coupling members of H shape steel are coupled to the upper and lower floor beams, respectively, by the knee braces.

(3) A damping intermediate pillar, wherein the knee braces described in (1) or (2) are replaced by a plurality of reinforcing ribs, one or both sides of the intermediate pillar and one side of each of the reinforcing ribs are fixed to each other, and the other side of each of the reinforcing ribs and the beams of the upper and lower floors are fixed to each other.

(4) A damping intermediate pillar as described in (1) or (2), wherein the knee braces are replaced by a plurality of reinforcing ribs, one side of each of the reinforcing ribs and the flange of the corresponding one of the coupling members of H shape steel are fixed to each other, and the other side of each of the reinforcing ribs and the corresponding beam flange of the upper and lower floors are fixed to each other.

(5) A damping structure, comprising a plurality of damping intermediate pillars between adjacent pillars according to any one of (1) to (4).

According to this invention, in addition to the joins for fixing a damping intermediate pillar by welding or bolting to the beams of the upper and lower floors, knee braces or reinforcing ribs are used to couple one or both sides of the damping intermediate pillar or the coupling members to the beams of the upper and lower floors, thereby improving the strength of the joins, as a whole, between the damping intermediate pillar and the beams. Therefore, a sufficient resistance can be exhibited, with comparative ease, against a large horizontal force acting on a building at the time of an earthquake of a large magnitude. Also, the use of the knee braces or the reinforcing ribs for coupling increases the shearing deformation of the viscoelastic material, thereby making it possible to absorb a larger amount of vibration energy.

BRIEF DESCRIPTION OF THE DRAWINGS

FIG. 19D is a partially enlarged view of FIG. 19B.

DESCRIPTION OF THE PREFERRED EMBODIMENTS

Embodiments of the invention will be explained in detail below with reference to the accompanying drawings.

Figure 1A:
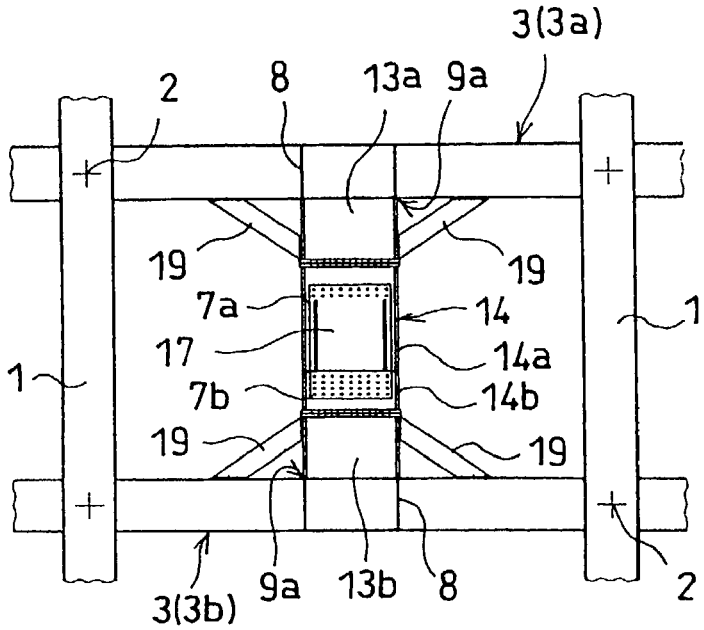
FIG. 1A is a schematic diagram showing a structural arrangement of a damping intermediate pillar according to an embodiment of the invention.
Figure 1B:
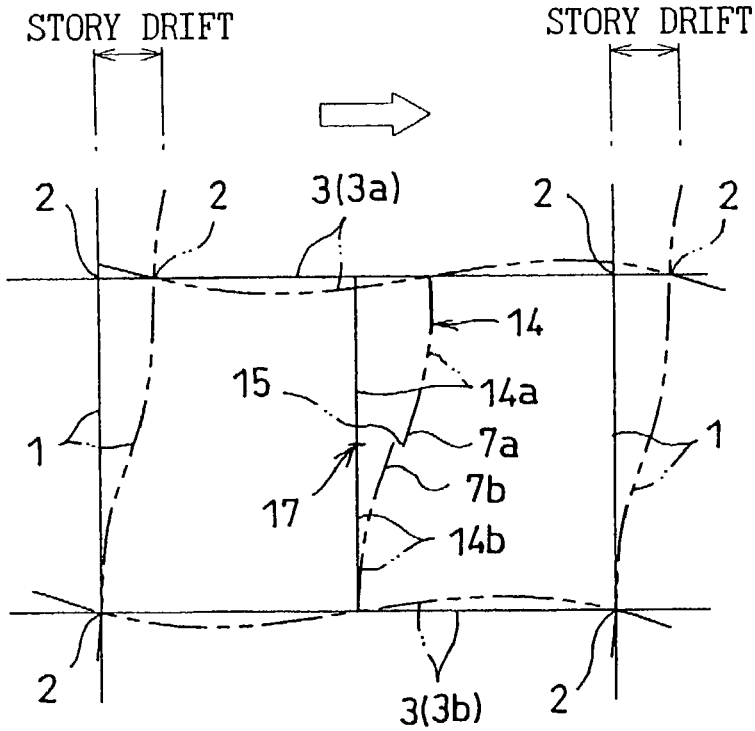
FIG. 1B is a diagram for explaining the attenuation effect of the structural frame of a building having a damping intermediate pillar according to a first embodiment at the time of an earthquake.
Figure 23A:
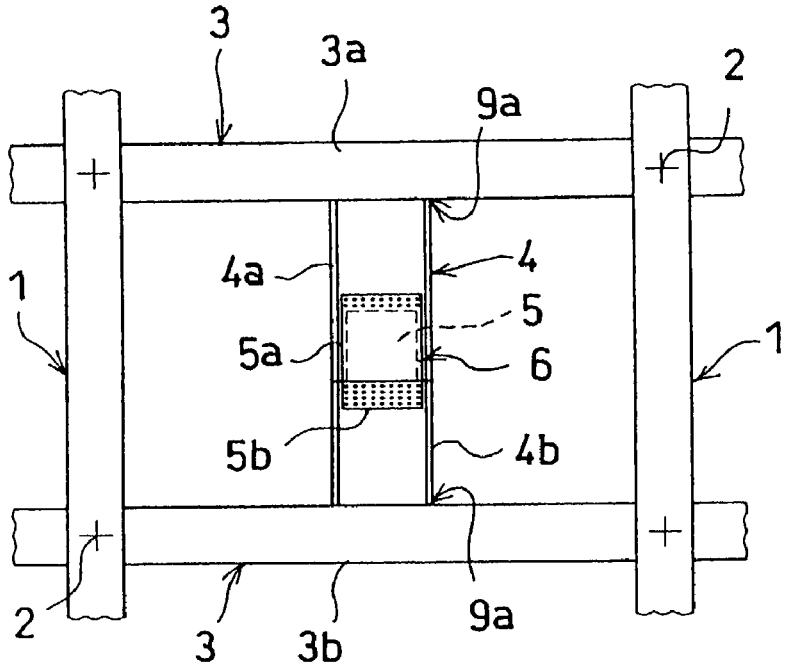
FIG. 23A is a schematic diagram showing a structural arrangement of a damping intermediate pillar with a viscoelastic damper built therein according to the prior art.
Figure 23B:
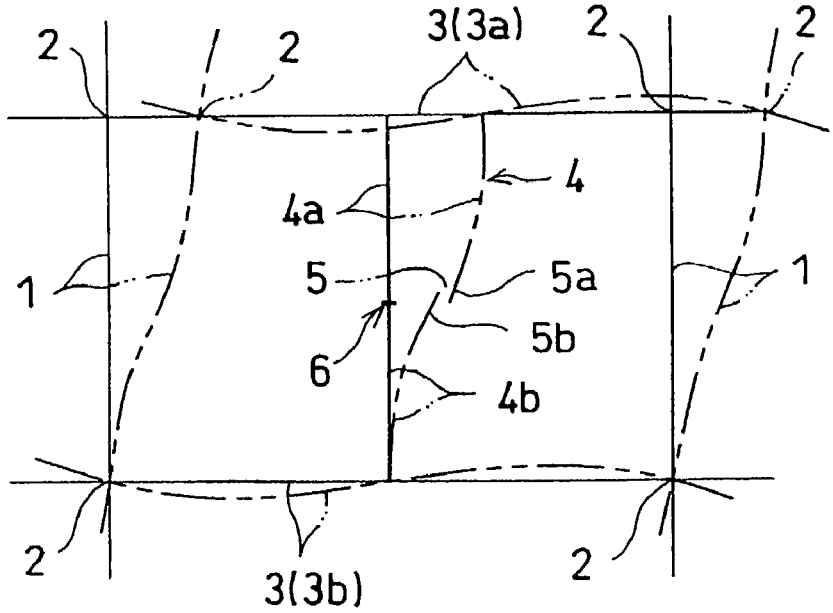
FIG. 23B is a diagram for explaining the attenuation effect of the structural frame of a building having a conventional damping intermediate pillar with a viscoelastic damper built therein at the time of an earthquake.

FIGS. 1 to 4 show a first embodiment of the invention, in which FIGS. 1A and 1B, corresponding to FIGS. 23A and 23B for explaining the prior art, are diagrams schematically showing the structural arrangement of a damping intermediate pillar having a viscoelastic damper built therein for explaining the attenuation effect of the structural frame of a building.

In FIG. 1, the structural frame of the building includes a pillar 1 of a rectangular steel pipe filled with concrete and beams 3 of H shape steel coupled to each other by pillar-beam joins 2. The structure also includes a damping intermediate pillar 14 having a viscoelastic damper 17 arranged between the beams 3*a* and 3*b* of the upper and lower floors. The structure for fixing the damping intermediate pillar 14 and the beams 3 is different from that of the prior art.

Figure 2:
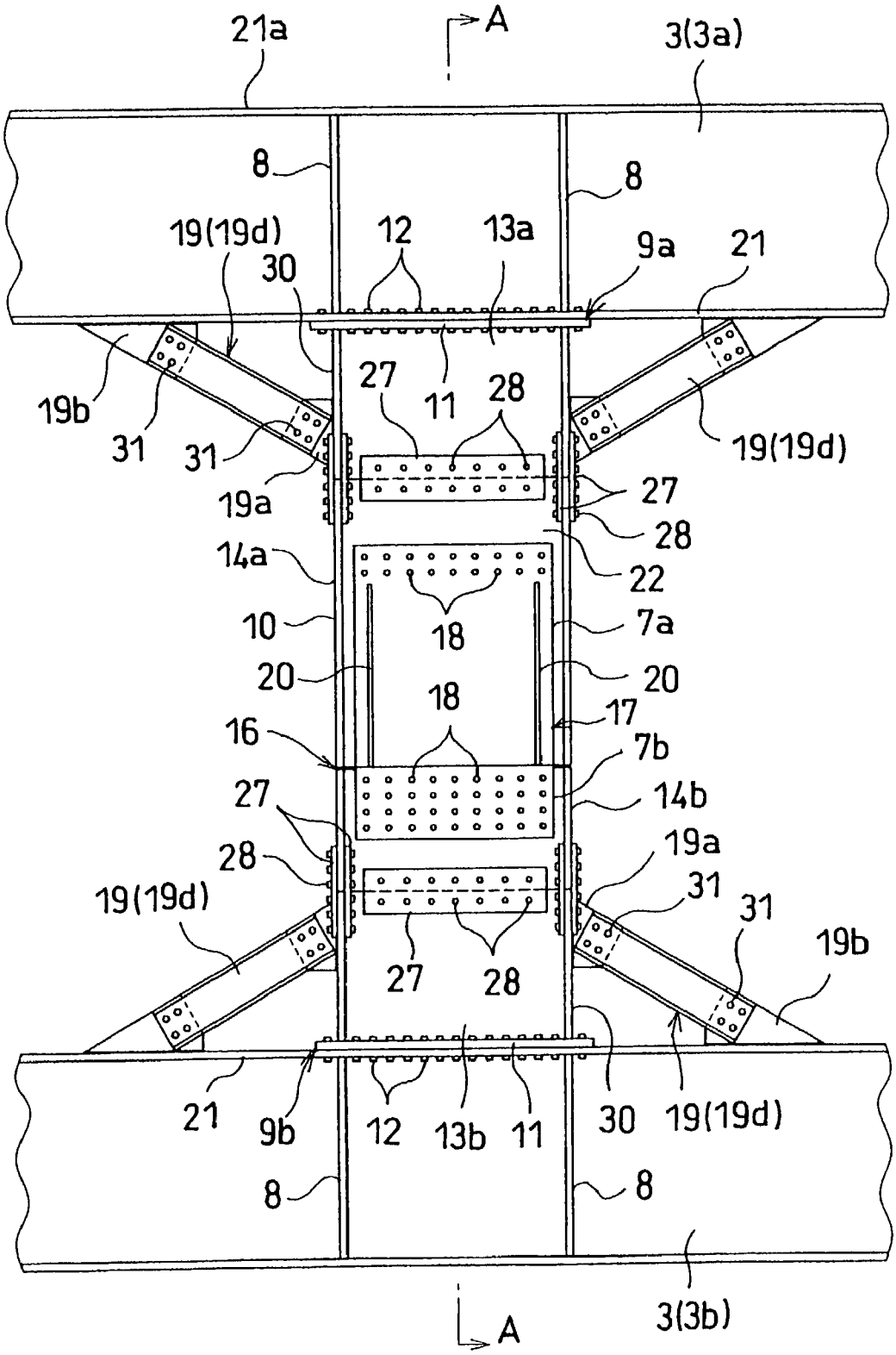
FIG. 2 is an enlarged front view of the damping intermediate pillar shown in FIG. 1.
Figure 3:
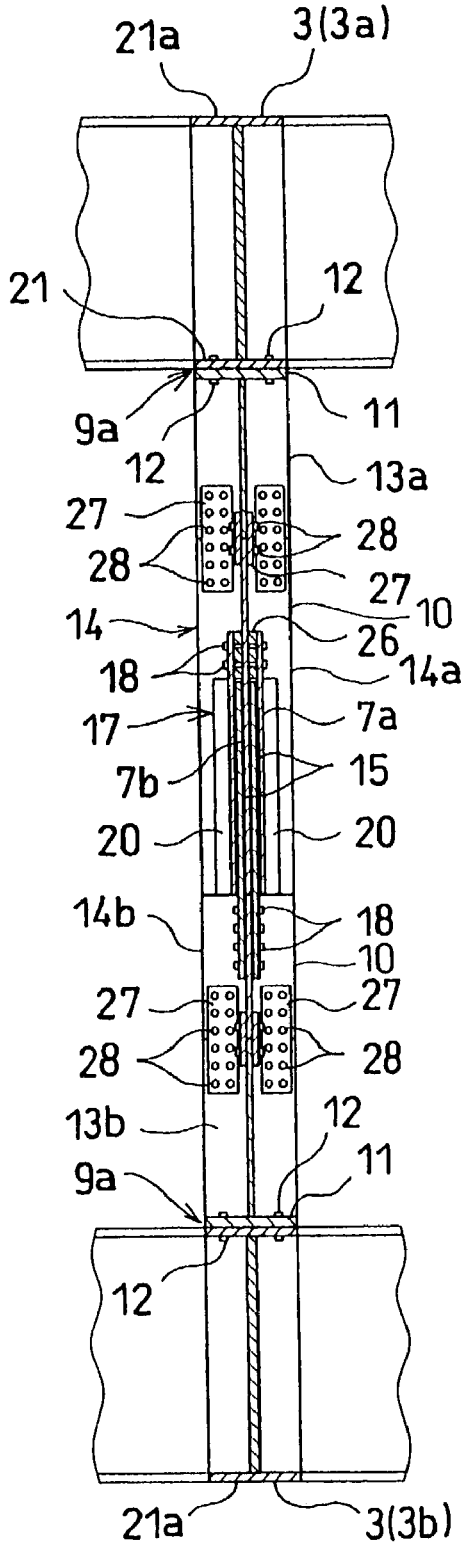
FIG. 3 is a sectional view taken in line A—A in FIG. 2.
Figure 4:
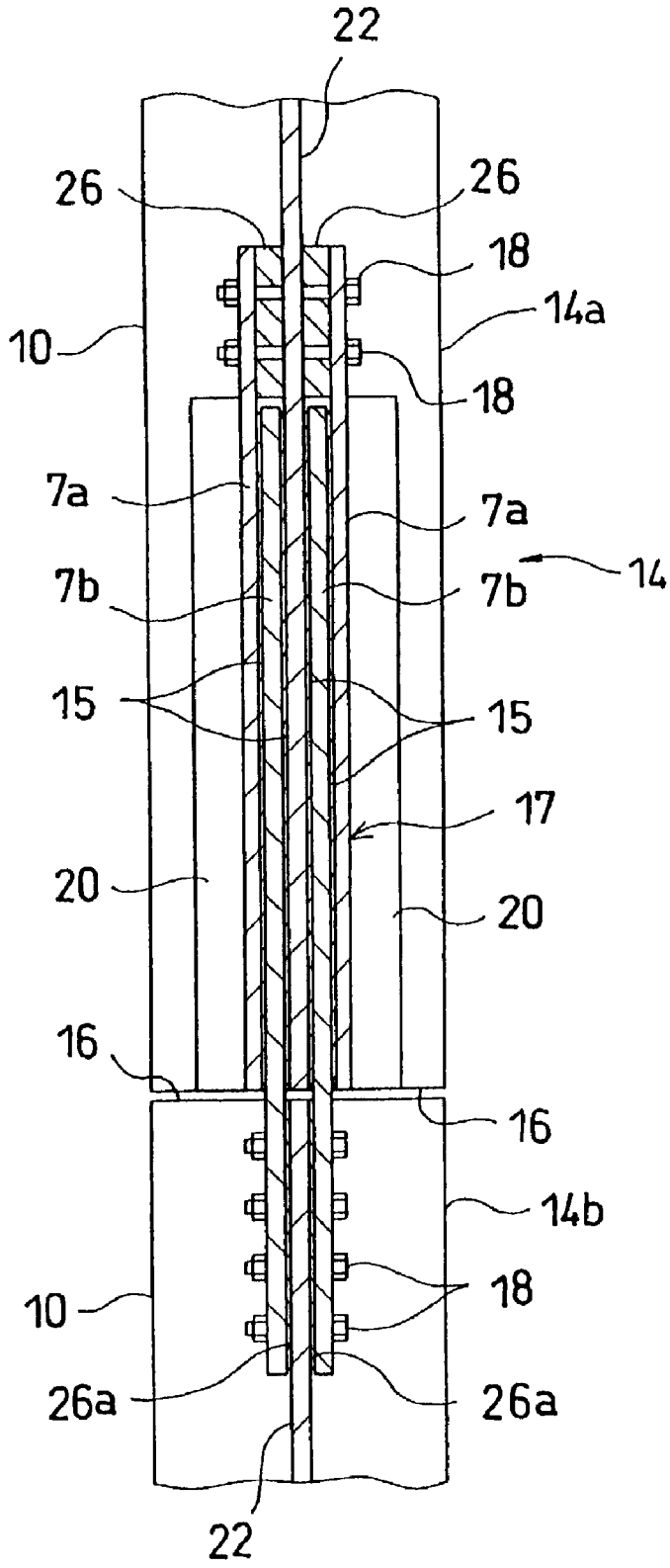
FIG. 4 is an enlarged sectional view of a viscoelastic damper shown in FIG. 3.
Figure 5A:
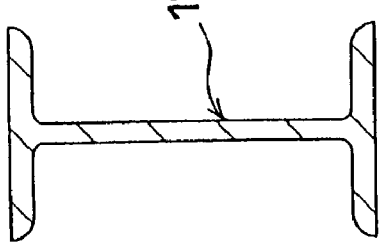
FIG. 5A is a sectional view showing an example of the sectional shape of a knee brace.
Figure 5B:
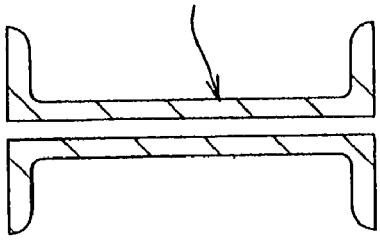
FIG. 5B is a sectional view showing another example of the sectional shape of a knee brace.
Figure 5C:
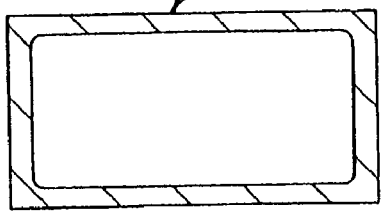
FIG. 5C is a sectional view showing still another example of the sectional shape of a knee brace.
Figure 5D:
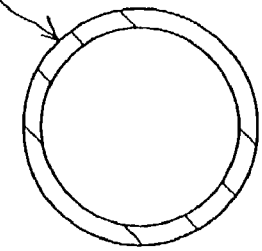
FIG. 5D is a sectional view showing yet another example of the sectional shape of a knee brace.
Figure 5E:
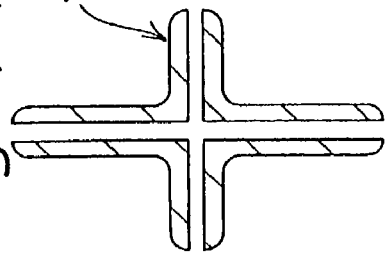
FIG. 5E is a sectional view showing a further example of the sectional shape of a knee brace.

FIGS. 2 to 4 show a detailed structure of the first embodiment, in which FIG. 2 is an enlarged front view showing the manner in which the viscoelastic damper is mounted, FIG. 3 a sectional view taken in line A—A in FIG. 2, and FIG. 4 an enlarged view of the mounting portion of the viscoelastic damper.

In each of the drawings, the damping intermediate pillar 14 of H steel is segmented into an upper damping intermediate pillar portion 14*a* and a lower damping intermediate pillar portion 14*b*. Coupling plates 27 are fixed to the outer ends (the end portions in opposed relation to coupling members 13) of the upper damping intermediate pillar 14*a* and the lower damping intermediate pillar 14*b*, respectively. Coupling plates 27 fixed to the inner ends (the end portions in opposed relation to the damping intermediate pillar) of the upper and lower coupling members 13*a*, 13*b* are fixed to each other by fixing bolts 28, respectively. The coupling members 13*a*, 13*b* are formed of H shape steel and welded at a welding point 9 directly to the beams 3*a*, 3*b* of the upper and lower floors (the coupled portion is called the join 9*a*). As an alternative, an end coupling plate 11 is welded to the outer end (the end portions in opposed relation to the beam) of each of the coupling members 13*a*, 13*b*, and fixed by fixing bolts to the inner flanges 21 of the beams 3*a*, 3*b* of the upper and lower floors (not shown). On the longitudinal extension of the damping intermediate pillar 14, a reinforcing plate 8 is welded between the inner and outer flanges 21, 21*a* of the beams 3*a*, 3*b* of the upper and lower floors, respectively.

The configuration of the viscoelastic damper 17 is shown in the sectional view of FIG. 4. The forward ends 16 of the upper damping intermediate pillar portion 14*a* and the lower damping intermediate pillar portion 14*b* into which the damping intermediate pillar 14 is segmented are arranged in a closely spaced relationship with each other at the shown position. Inner and outer steel plates 7*a*, 7*b* are arranged in parallel to the web 22 of the damping intermediate pillar 14 and fixed by fixing bolts 18 in such a manner as to project from the forward ends on both sides of the web of the upper damping intermediate pillar portion 14*a* and the lower damping intermediate pillar portion 14*b*, respectively. The inner and outer steel plates 7*a*, 7*b* vertically arranged in opposite directions have the comb teeth thereof in mesh with each other through a plurality of gaps. A plurality of rectangular viscoelastic members 15 of a solid material 2.0 $m^2$ in area and 5 mm thick, for example, are held in a plurality of the gaps formed between the inner and outer steel plates 7*a*, 7*b*, and have the side surfaces fixed on the side surfaces of the inner and outer steel plates 7*a*, 7*b*. The inner and outer steel plates 7*a*, 7*b* located at upper and lower positions, respectively, are arranged in alternate layers through the gaps. Thus, the inner steel plates 7*b* on the lower side are fixed through spacers 26*a* to both sides of the web of the lower damping intermediate pillar portion 14*b*, while the outer steel plates 7*a* on the upper side are fixed through spacers 26 to both sides of the web of the upper damping intermediate pillar portion 14*a*.

The width of the rectangular viscoelastic members 15 and the inner and outer steel plates 7*a*, 7*b* is smaller than the distance between the flanges 10 on the two sides of the upper damping intermediate pillar portion 14*a* of H steel and, therefore, they can be accommodated between the flanges 10. The rectangular viscoelastic members 15 located inside are covered and protected by the outer steel plates 7*a* located on the outside. The outer steel plates 7*a* may be provided with stiffening plates 20.

According to the first embodiment of the invention, the coupling members 13*a*, 13*b* and the upper and lower floor beams 3*a*, 3*b* are coupled (at the joins 9*a*) directly to each other at the welding points 9 as described above or are fixed to each other by fixing bolts through the flanges not shown. In addition, the two sides of the coupling members 13*a*, 13*b* and the upper and lower floor beams 3*a*, 3*b* are coupled to each other by knee braces 19. As a result, the strength of the joins 9*a* between the damping intermediate pillar portions 14*a*, 14*b* and the upper and lower floor beams 3*a*, 3*b* is reinforced.

For the knee braces 19, any material can be employed such as a steel plate or a H shape steel member of a predetermined thickness having a buckling strength with a sectional structure shown in FIG. 5. Specifically, FIG. 5A shows a knee brace 19*c* of H shape steel, FIG. 5B a knee brace 19*d* of channel-shaped steel members coupled back to back, FIG. 5C a knee brace 19*e* of a rectangular steel member, FIG. 5D a knee brace 19*f* in the form of a steel pipe, and FIG. 5E a knee brace 19*g* of four angle-shaped steel members coupled back to back. The knee braces 19 shown in FIG. 2 have the same section as the knee brace 9*d* shown in FIG. 5B, and have the ends thereof fixed by fixing bolts 31 to the gusset plates 19*a*, 19*b* fixed on the flange 30 of the H shape steel coupling members 13*a*, 13*b* and the inner flanges 21 of the beams 3*a*, 3*b*.

The operation of the first embodiment will be explained. According to the first embodiment, at the time of an earthquake, the horizontal force acting on the beams 3*a*, 3*b* at the upper and lower parts of the structural body is transmitted as a shearing force to and deforms the viscoelastic members 15 through the upper and lower damping intermediate pillar portions 14*a*, 14*b*. The vibration of the building is attenuated as the attenuation effect is transmitted from the viscoelastic members 15 via the upper and lower damping intermediate pillar portions 14*a*, 14*b* and the end portions of the beams 3*a*, 3*b* to the pillar-beam joins 2.

In the case where an excessive horizontal force of a strong earthquake is exerted on the building of the conventional structure, the attenuation effect is not exhibited by the viscoelastic member 15 because an excessive local shearing force acts on the joins 9*a* with the fixing bolts 12 (which may alternatively be a weld zone) between the damping intermediate pillar portions 14*a*, 14*b* (i.e. the coupling members 13*a*, 13*b*) and the beams 3*a*, 3*b*, thereby often shearing off the fixing bolts 12 (or breaking the weld zone, as the case may be) of the joins 9*a*. According to the first embodiment, in contrast, the stress acting on the joins between the coupling members 13*a*, 13*b* and the beams 3*a*, 3*b* is received by the knee braces 19 having a large buckling resistance, and therefore, the stress is not concentrated on the joins 9*a* with the fixing bolts 12 (or the weld zone), so that the attenuation effect is positively exhibited by the damping intermediate pillar portions 14*a*, 14*b* even when an earthquake of large magnitude occurs. In addition, the larger shearing deformation of the viscoelastic member 15 can absorb more vibration energy.

Figure 6:
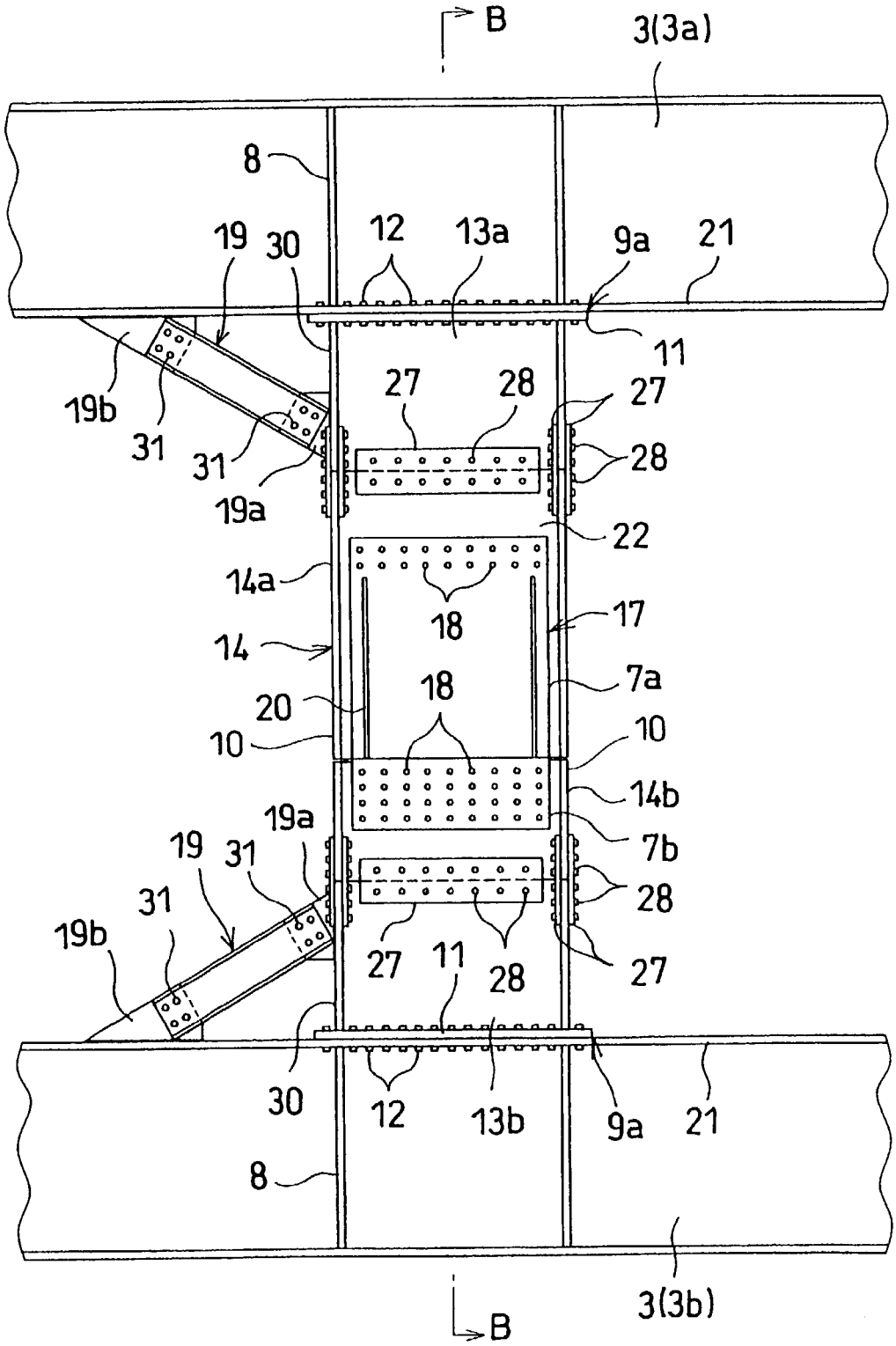
FIG. 6 is a diagram showing in detailed a structural arrangement of a damping intermediate pillar according to a second embodiment of the invention.
Figure 7:
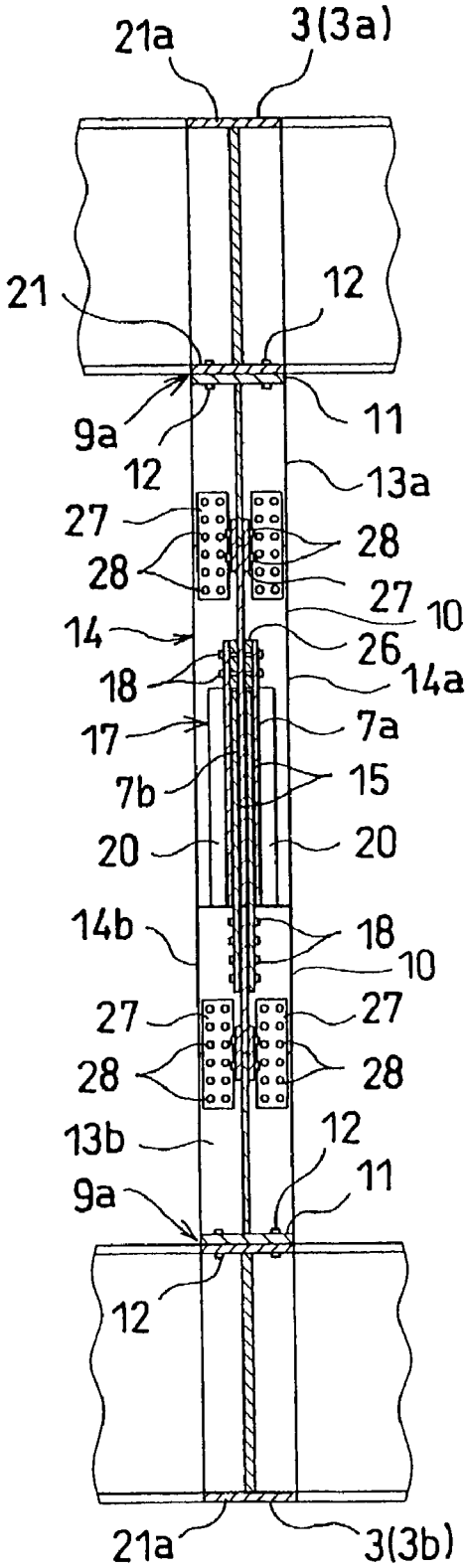
FIG. 7 is a sectional view taken in line B—B in FIG. 6.
Figure 8:
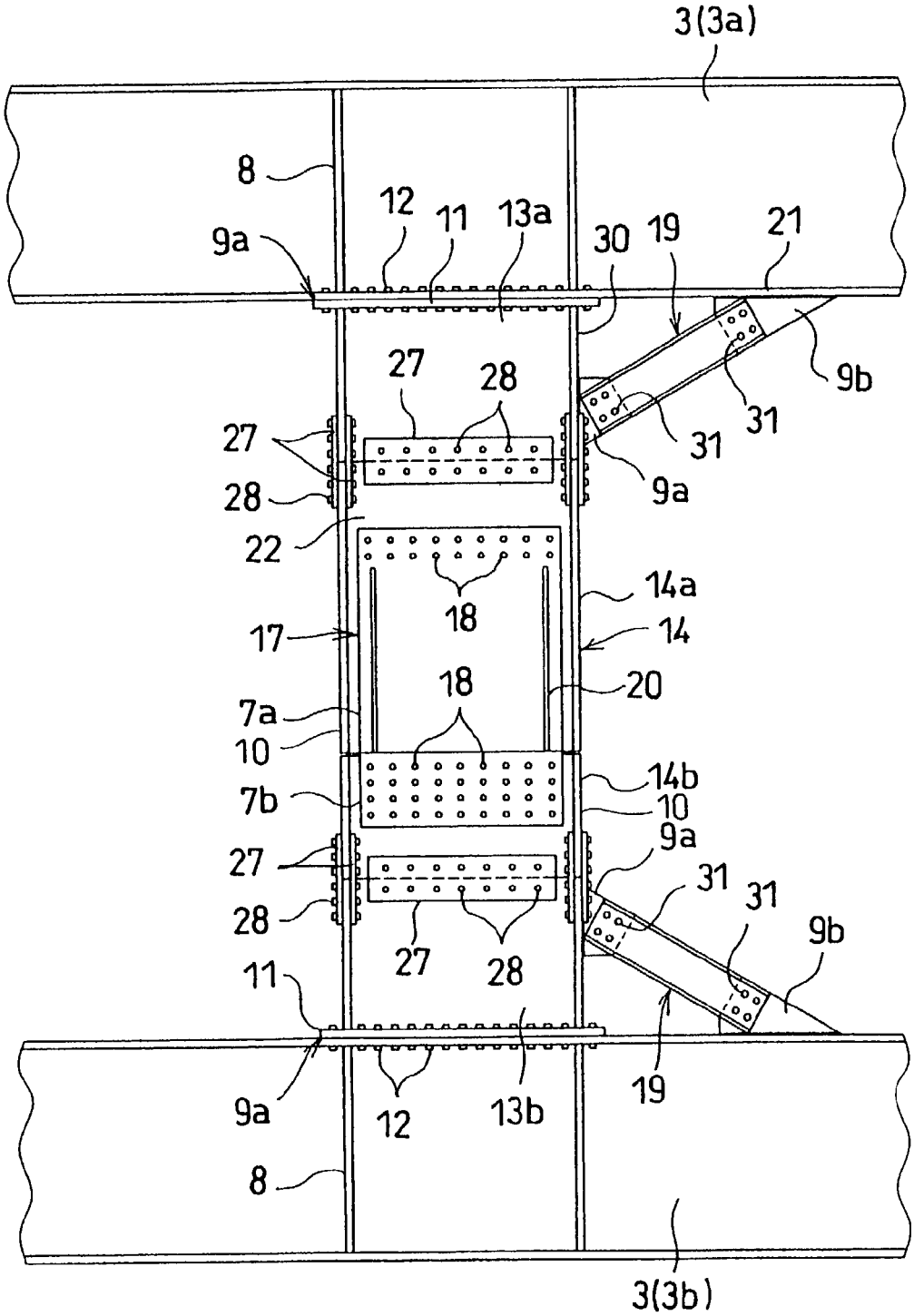
FIG. 8 is a diagram showing in detail a structural arrangement of a damping intermediate pillar according to a third embodiment of the invention.
Figure 9:
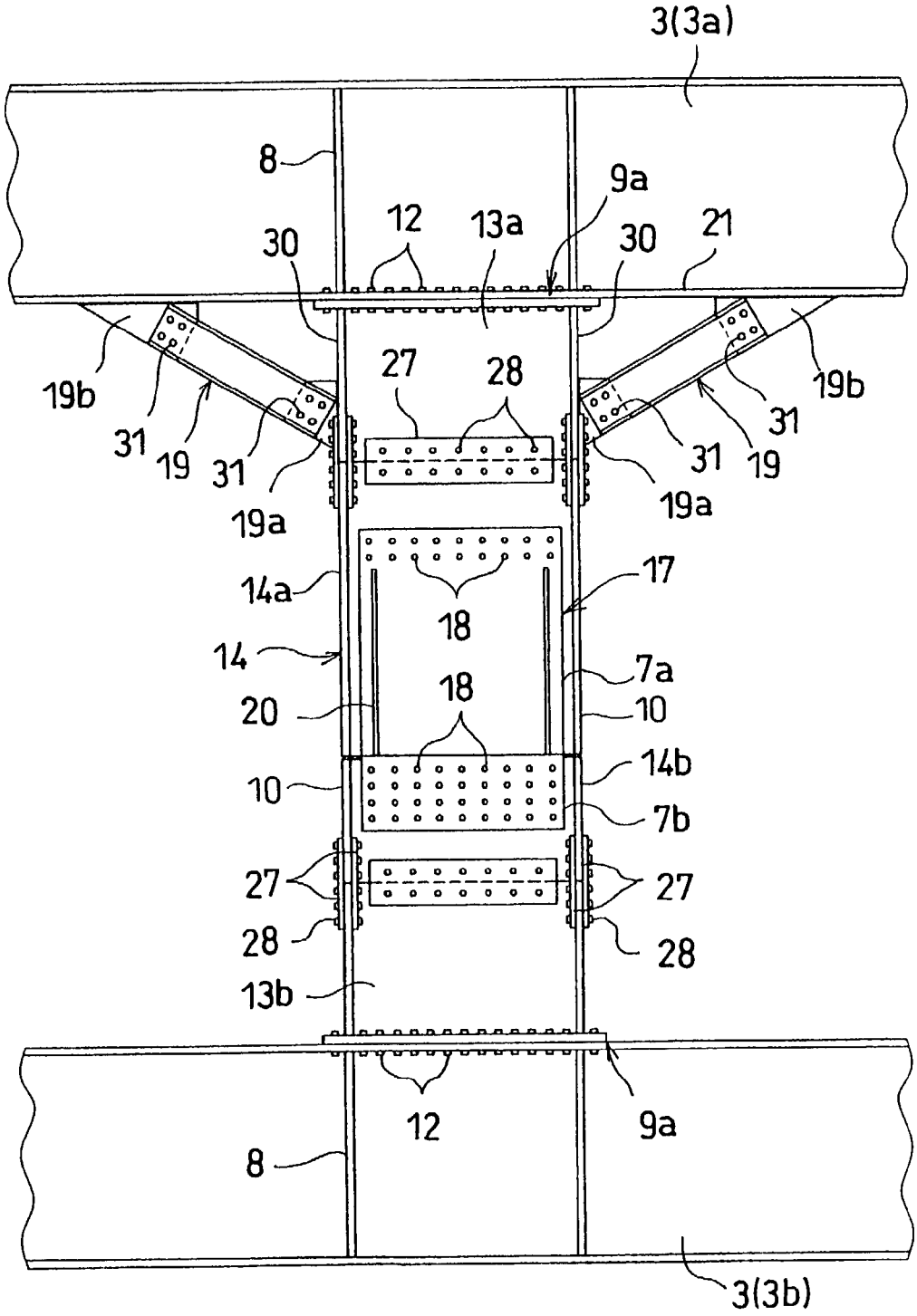
FIG. 9 is a diagram showing in detail a structural arrangement of a damping intermediate pillar according to a fourth embodiment of the invention.
Figure 10:
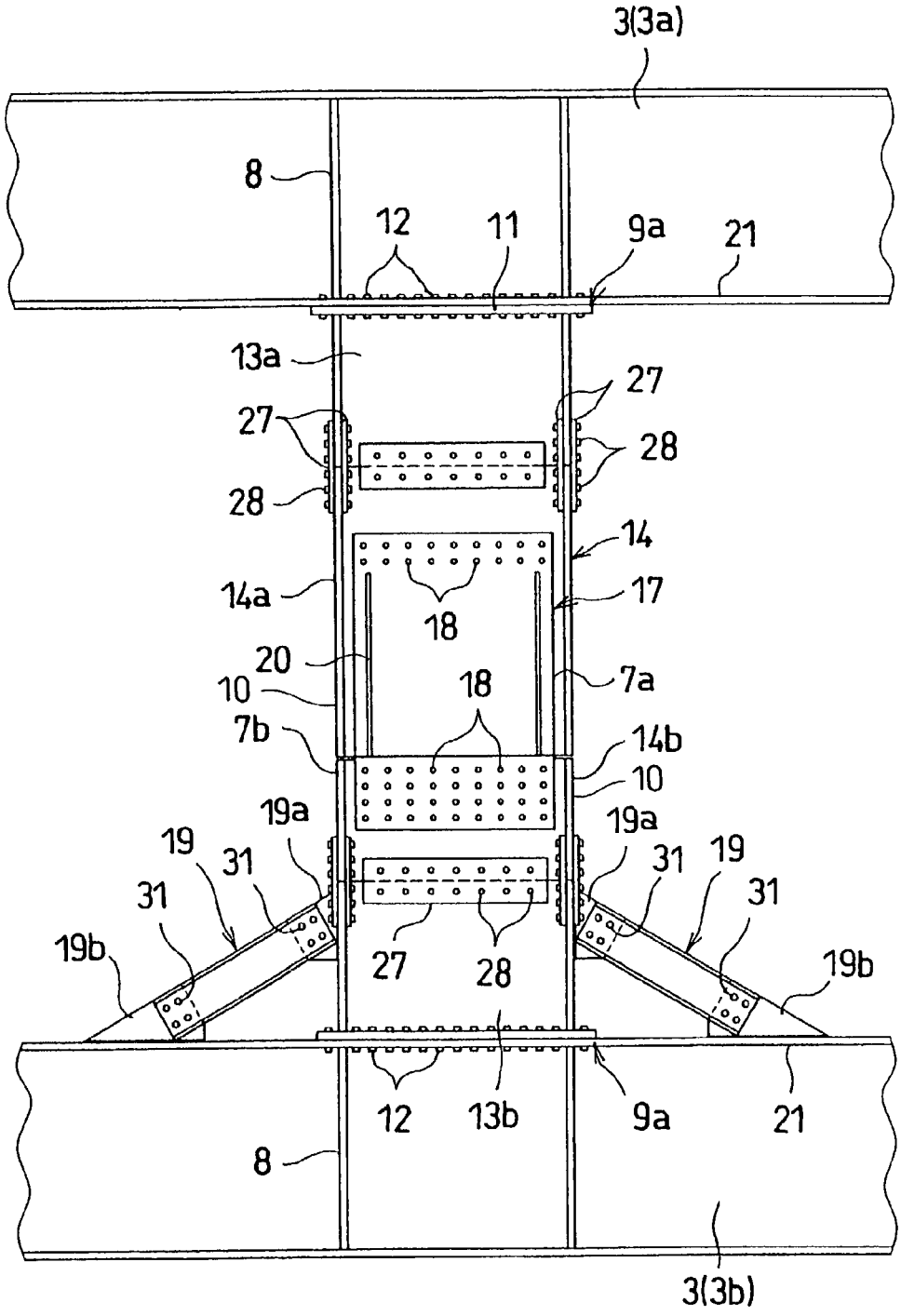
FIG. 10 is a diagram showing in detail a structural arrangement of a damping intermediate pillar according to a fifth embodiment of the invention.
Figure 11:
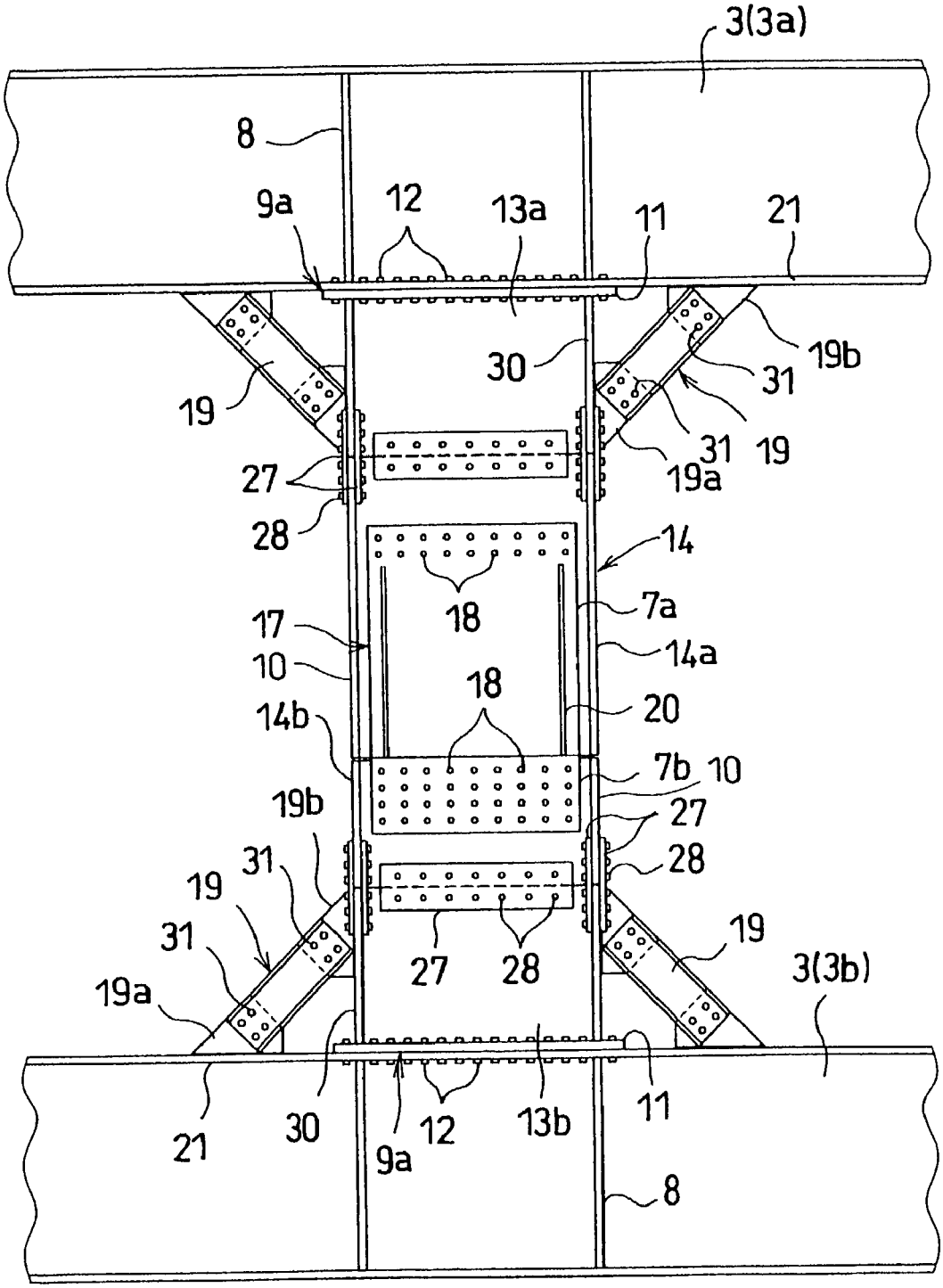
FIG. 11 is a diagram showing in detail a structural arrangement of a damping intermediate pillar according to a sixth embodiment of the invention.
Figure 12:
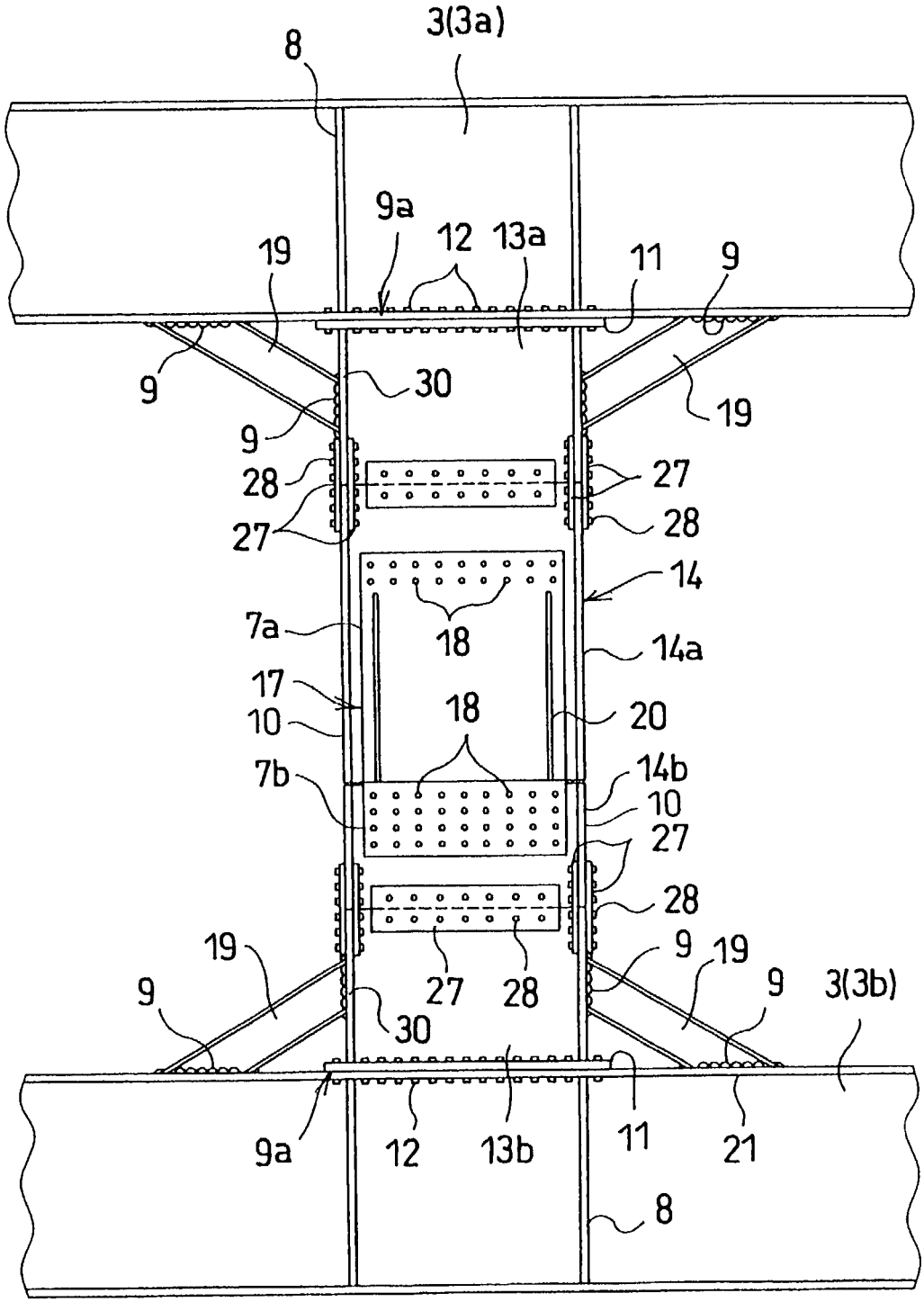
FIG. 12 is a diagram showing in detail a structural arrangement of a damping intermediate pillar according to a seventh embodiment of the invention.

In the first embodiment, the knee braces 19 are arranged on both sides of the coupling members 13*a*, 13*b*, as shown. In the second embodiment, however, as shown in FIGS. 6 and 7, the knee braces 19 may be arranged only on the side of the coupling members 13*a*, 13*b*. As another alternative, as shown in FIG. 8 of the third embodiment, the knee braces 19 may be arranged only on the right side of the coupling members 13*a*, 13*b*. Further, as shown in FIG. 9 of the fourth embodiment, the left and right knee braces 19 may be arranged only for the upper coupling member 13*a*. As still another alternative, as shown in FIG. 10 of the fifth embodiment, the left and right knee braces 19 may be arranged only for the lower coupling member 13*b*. Also, as shown in FIG. 11 of the sixth embodiment, the left and right knee braces 19 may be arranged at a steeper angle than in the first embodiment shown in FIG. 2. Further, as shown in FIG. 12 as the seventh embodiment, the ends of the knee braces 19 may be fixed by welding 9 to the flanges 30 on both sides of the coupling members 13*a*, 13*b*, and the inner flanges 21 of the beams 3*a*, 3*b* of the upper and lower floors.

The knee braces 19 may alternatively be fixed, though not shown, to the flanges 10 of the damping intermediate pillar portions 14*a*, 14*b* instead of to the flanges 30 of the coupling members 13*a*, 13*b*. In this case, the length of each knee brace 19 increases with the change in the inclination angle of the knee braces 19. The coupling members 13*a*, 13*b* may be done without, in which case, the damping intermediate pillar portions 14*a*, 14*b* are lengthened with the end portions thereof fixed directly to the inner flanges 21 of the beams 3*a*, 3*b* of the upper and lower floors. Also in this case, the knee braces 19 are fixedly bolted to the flanges 10 of the upper and lower damping intermediate pillar portions 14*a*, 14*b*.

As explained above, the knee braces are coupled to one or both sides of the upper and/or lower coupling members.

The knee braces may be coupled to one or both sides of the upper and/or lower intermediate pillar portions.

The knee braces are fixed to the corresponding beams of the upper and lower floors.

Figure 13:
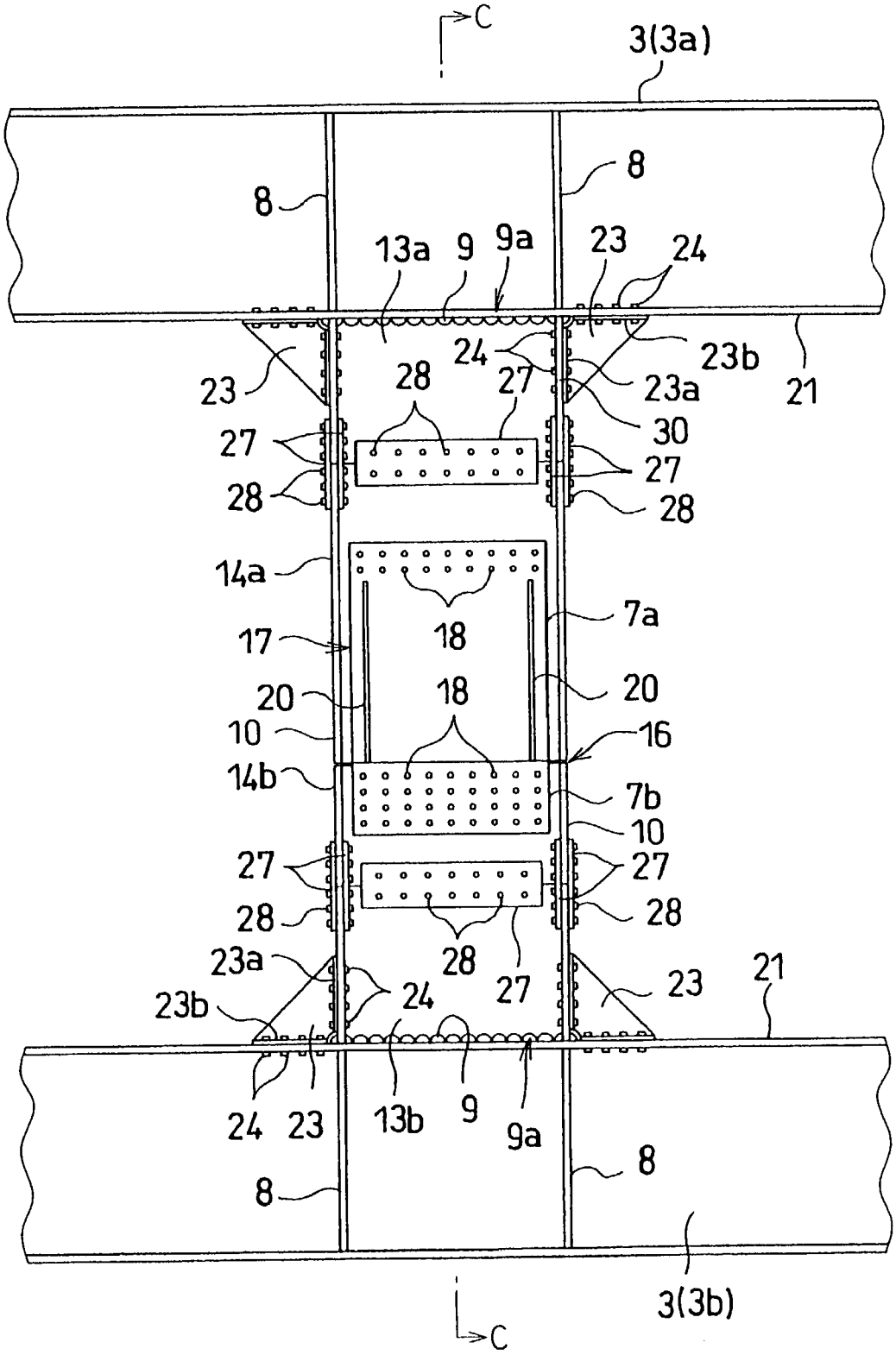
FIG. 13 is a diagram showing in detail a structural arrangement of a damping intermediate pillar according to an eighth embodiment of the invention.
Figure 14:
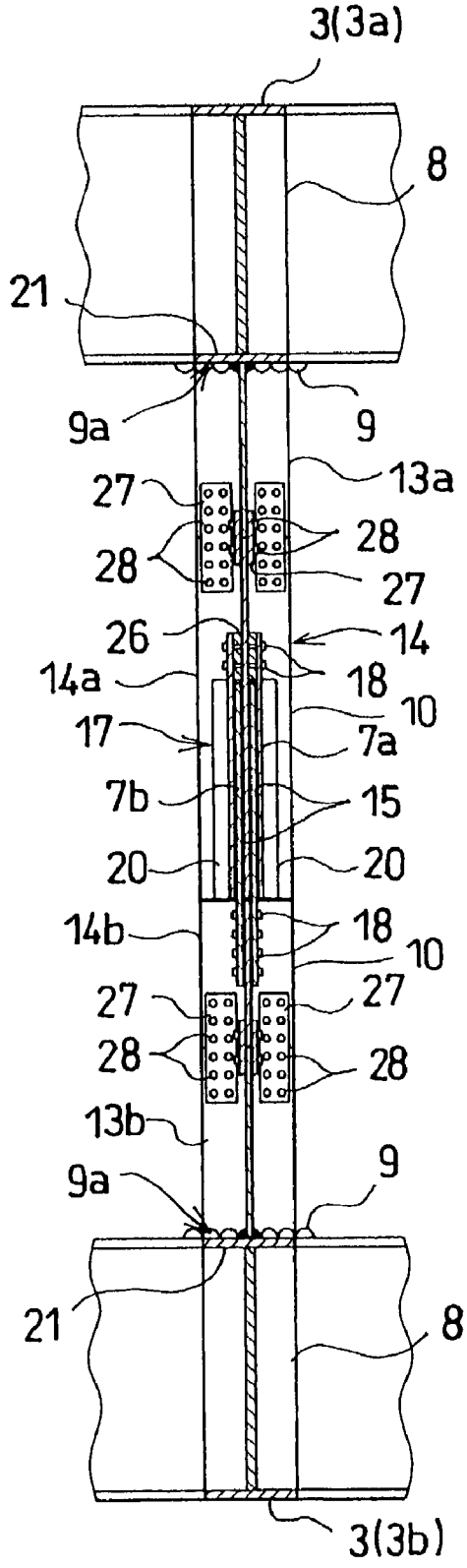
FIG. 14 is a sectional view taken in line C—C in FIG. 13.

FIGS. 13 and 14 show an eighth embodiment. FIG. 13 is a front view showing the manner in which the damping intermediate pillar 14 is mounted, and FIG. 14 a sectional view taken in line C—C in FIG. 13. The eighth embodiment is different from the first to seventh embodiments in that the knee braces 19 are replaced by reinforcing ribs 23 in each of the embodiments described above. The reinforcing ribs 23 are each formed of a steel plate of a predetermined thickness in the shape of a right triangle, and include mounting plates 23*a*, 23*b* on the two sides forming the right angle. As shown in FIGS. 13, 14, the mounting plate 23*a* on one side of the reinforcing rib 23 is applied to the flange 30 of the coupling members 13*a*, 13*b*, and is coupled by fixing bolts 24. At the same time, the mounting plate 23*b* on the other side of each reinforcing rib 23 is applied to the inner flange 21 of the upper and lower beams 3*a*, 3*b*, and is fastened by fixing bolts 24. According to the eighth embodiment, the joins 9*a* between the upper and lower coupling members 13*a*, 13*b* and the inner flanges 21 of the upper and lower beams 3*a*, 3*b* are formed by welding as designated by 9. The remaining configuration is identical to that of the first embodiment and will not be explained.

Figure 15:
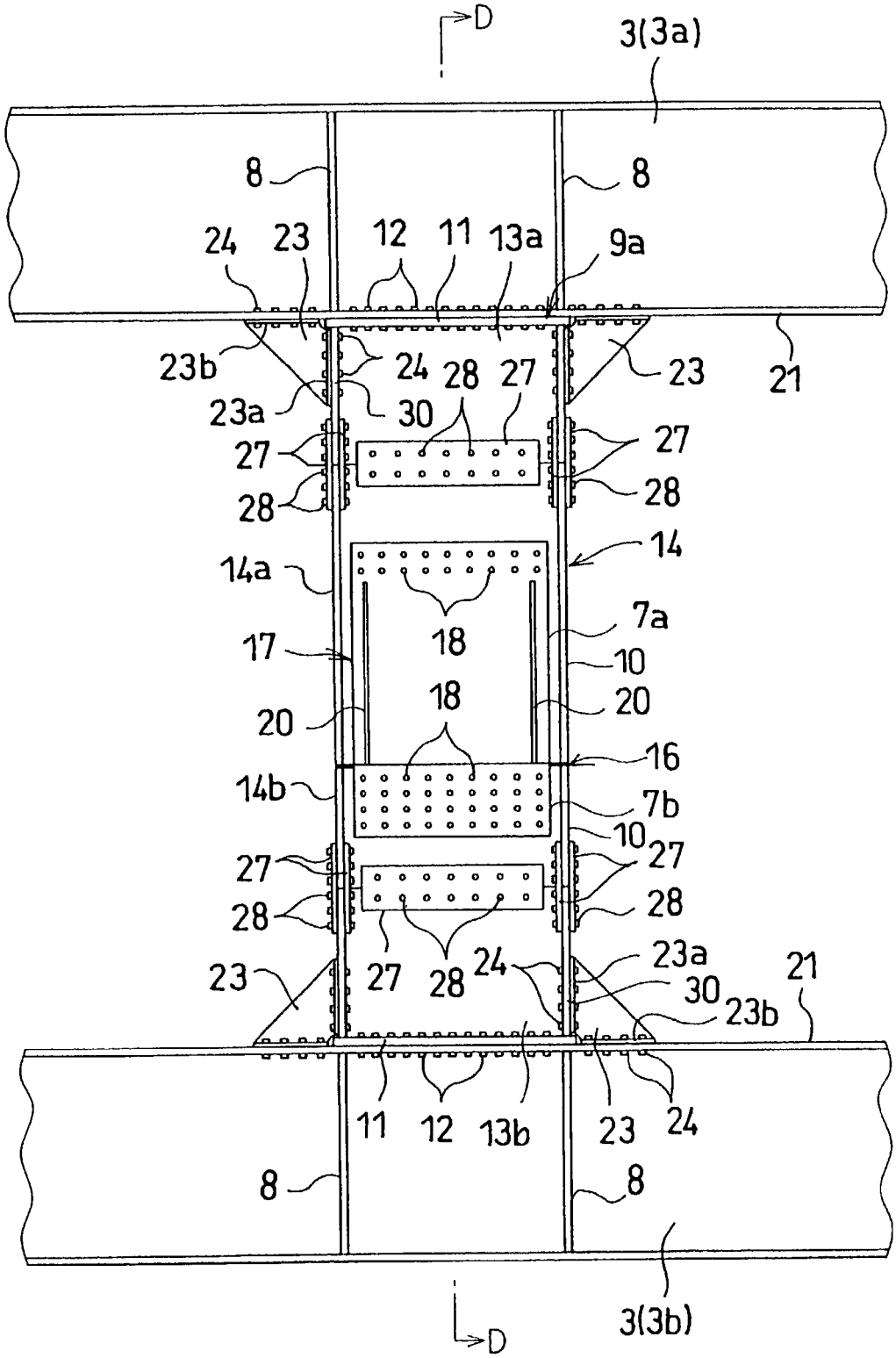
FIG. 15 is a diagram showing in detail a structural arrangement of a damping intermediate pillar according to a ninth embodiment of the invention.
Figure 16:
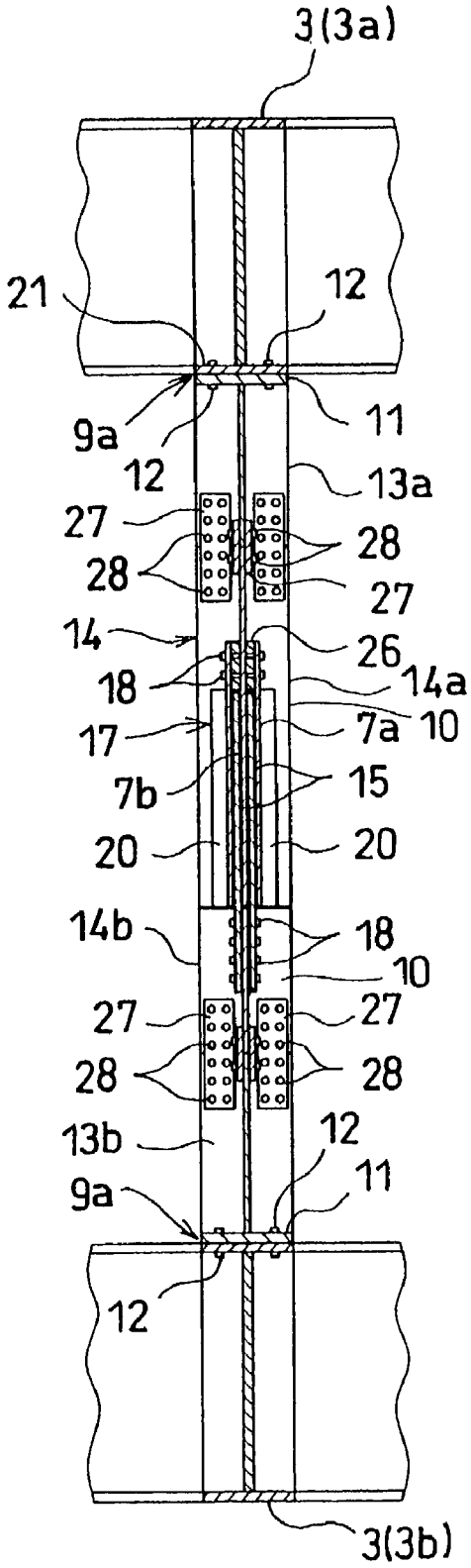
FIG. 16 is a sectional view taken in line D—D in FIG. 15.

FIGS. 15 and 16 show a ninth embodiment, in which FIG. 15 is a front view showing the manner in which the damping intermediate pillar 14 is mounted, and FIG. 16 is a sectional view taken in line D—D in FIG. 15. The ninth embodiment is different from the eighth embodiment in that an end coupling plate 11 is welded to the outer end of each of the coupling members 13*a*, 13*b*. This end coupling plate 11 is applied to the corresponding inner flange 21 of the upper and lower floor beams 3*a*, 3*b* of H shape steel. These members are coupled to each other by fixing bolts 12 inserted through nuts, thereby fixing the upper and lower damping intermediate pillar portions 14*a*, 14*b* to the upper and lower beams 3*a*, 3*b*, respectively. The other configuration is identical to that of the eighth embodiment and will not be explained.

Also in the eighth and ninth embodiments, the stress acting on the joins 9*a* between the coupling members 13*a*, 13*b* and the beams 3*a*, 3*b* is received by the reinforcing ribs 23 having a large buckling resistance. Therefore, the stress is not concentrated only on the joins 9*a* with the welding or the fixing bolts between the coupling member 13*a*, 13*b* and the beams 3*a*, 3*b*. In this way, the attenuation effect can be positively exhibited by the upper and lower damping intermediate pillar portions 14*a*, 14*b* even at the time of a strong earth quake. In addition, a greater amount of vibration energy can be absorbed.

Figure 17:
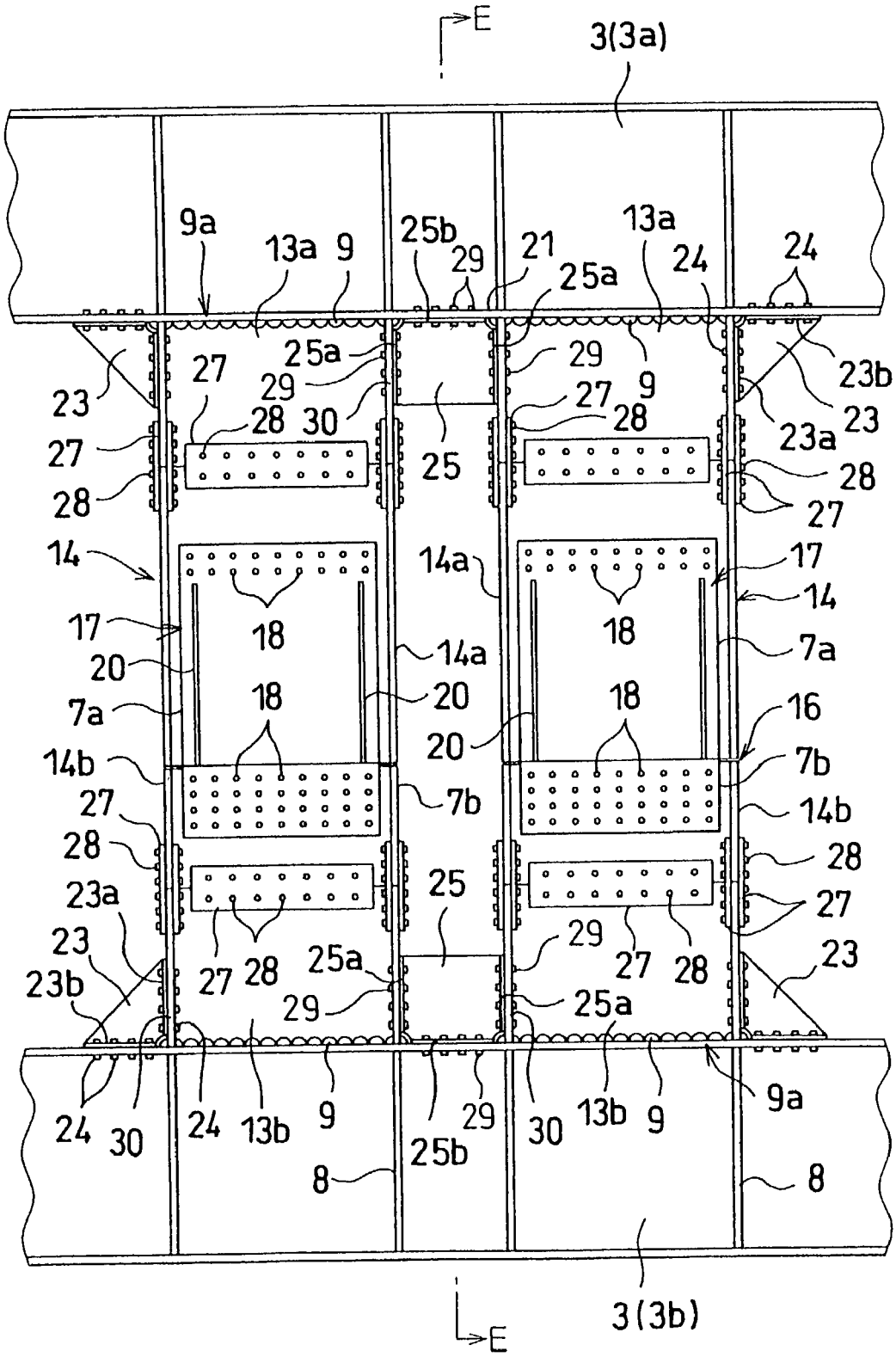
FIG. 17 is a diagram showing in detail a structural arrangement of a damping intermediate pillar according to a tenth embodiment of the invention.
Figure 18:
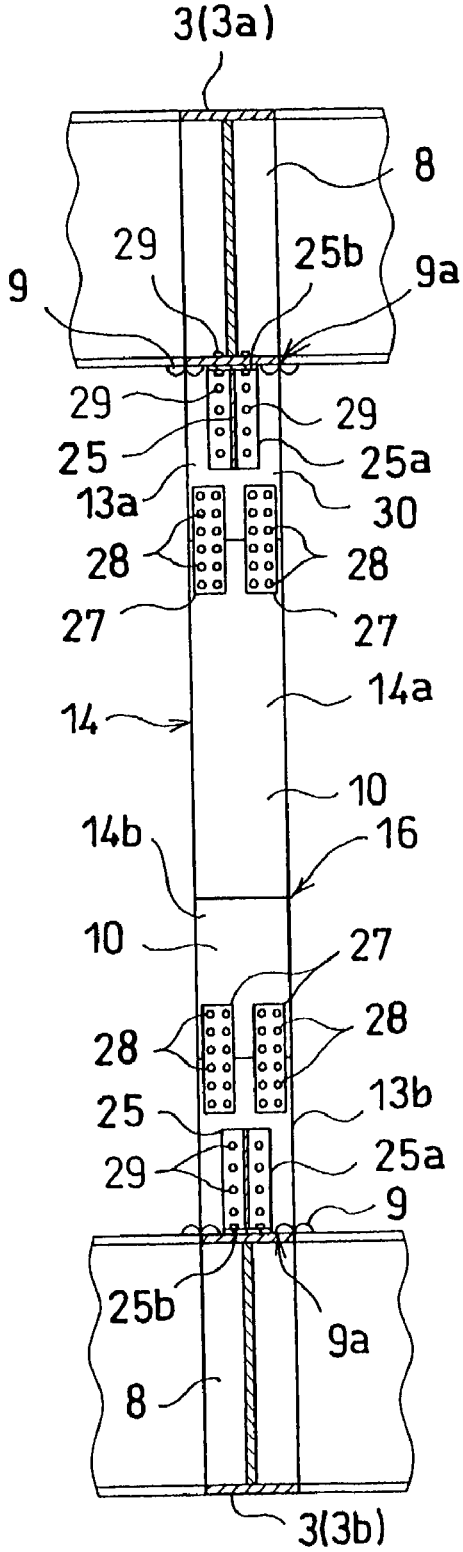
FIG. 18 is a sectional view taken in line E—E in FIG. 17.

FIGS. 17 and 18 show a tenth embodiment, in which FIG. 17 is a front view showing the manner in which damping intermediate pillars 14 are mounted, and FIG. 18 is a sectional view taken in line E—E in FIG. 17. The tenth embodiment is different from the first to ninth embodiments in that two damping intermediate pillars 14 are arranged at a small interval in the space formed by the upper and lower beams 3*a*, 3*b* and adjoining pillars 1. The reinforcing ribs 25 of a rectangular steel plate are arranged between the adjoining damping intermediate pillars 14, 14. The mounting plate 25*a* on one side of each of the reinforcing ribs 25 is coupled by a fixing bolt 29 to the flange 30 of the corresponding one of the coupling members 13*a*, 13*b* of the upper and lower damping intermediate pillar portions 14*a*, 14*b*, while the mounting plate 25*b* on the other side of the reinforcing rib 25 is coupled by a fixing bolt 29 to the inner flange 21 of the upper and lower beams 3*a*, 3*b*. As in the eighth and ninth embodiments, the outer flanges 30 (flanges closer to the adjoining pillar) of the coupling members 13*a*, 13*b* and the inner flanges 21 of the beams 3*a*, 3*b* are bolted to each other by the reinforcing ribs 23 in the shape of right angle, respectively.

As described above, according to the tenth embodiment, two (or a plurality of) damping intermediate pillars 14 are employed at the same time and summed up damping performance can be exhibited. As a result, the structural size of each damping intermediate pillar 14 can be reduced. This is more advantageous than a large damping intermediate pillar from the viewpoint of fabrication, transportation and construction. An especially great advantage is obtained in an application to a building having built therein a damping unit against an earthquake of large magnitude. Also in the tenth embodiment, the stress acting on the joins 9*a* between the coupling members 13*a*, 13*b* and the beams 3*a*, 3*b* is received by the reinforcing ribs 23, 25 having a large buckling resistance. Therefore, the stress is not concentrated only on the joins 9*a* with the melding or the fixing bolts between the coupling members 13*a*, 13*b* and the beams 3*a*, 3*b*. Thus, the damping intermediate pillar portions 14*a*, 14*b* can positively exhibit an attenuation effect even against a strong earthquake in the same manner as in the first to fourth embodiments.

Figures 19A, 19B, 19C:
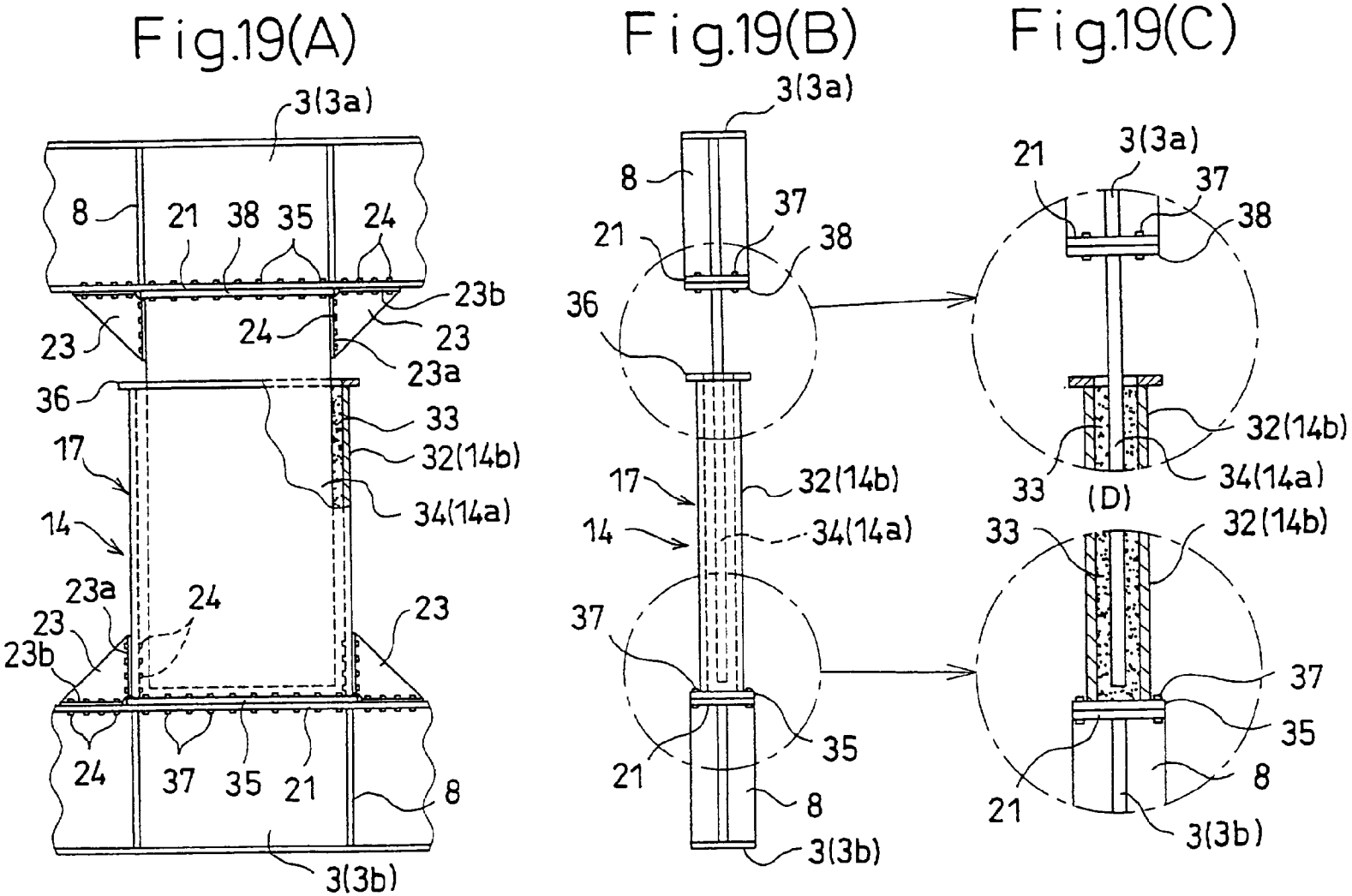
FIG. 19A is a front view showing a structural arrangement of a damping intermediate pillar according to an 11th embodiment of the invention.
FIG. 19B is a side view showing a structural arrangement of a damping intermediate pillar according to the 11th embodiment of the invention.
FIG. 19C is a partially enlarged view of FIG. 19B.

FIG. 19 shows an 11th embodiment of the invention, in which FIG. 19A is a front view showing the manner in which a damping intermediate pillar is mounted, FIG. 19B a side view thereof, and FIGS. 19C and 19D partially enlarged views of FIG. 19B. According to the 11th embodiment, the viscoelastic damper 17 is formed of a semi-liquid viscous material 33 instead of the solid viscoelastic member 15 in the first to tenth embodiments. Specifically, in the 11th embodiment, the semi-liquid viscous material 33 is filled in a damping box 32 doubling as the lower damping intermediate pillar portion 14*b*. In the semi-liquid viscous material 33, a damping steel member 34 doubling as the upper damping intermediate pillar portion 14*a* is inserted from above in a way movable in horizontal direction, thereby making up the damping intermediate pillar 14.

The damping box 32 is flat and rectangular in shape and, at an open upper end, has a reinforcing flange 36 fixed thereto. A bottom plate 35 of the damping box 32 is fixed by fixing bolts 37 to the inner flange 21 of the lower beam 3*b*. The mounting plate 38 fixed at the upper end of the damping steel member 34, on the other hand, is fixed by fixing bolts 37 to the inner flange 21 of the upper beam 3*a*. Further, according to the 11th embodiment, the sides of the upper and lower damping intermediate pillar portions 14*a*, 14*b* and the upper and lower beams 3*a*, 3*b* are coupled to each other by reinforcing ribs 23 in the shape of right triangle, in the same way as in the fourth and eighth embodiments. In the 11th embodiment, the reinforcing ribs 23 may be replaced by knee braces 19 (not shown) as in the first and second embodiments. The other configuration is similar to that of the eighth and ninth embodiments.

Also in the configuration of the 11th embodiment, when a horizontal fore acts on the beams 3 at the time of an earthquake, the damping effect is exhibited by the horizontal movement of the damping steel member 34 against the resistance of the semi-liquid viscous material 33 in the damping box 32 at the ends of the beams 3.

Figure 20:
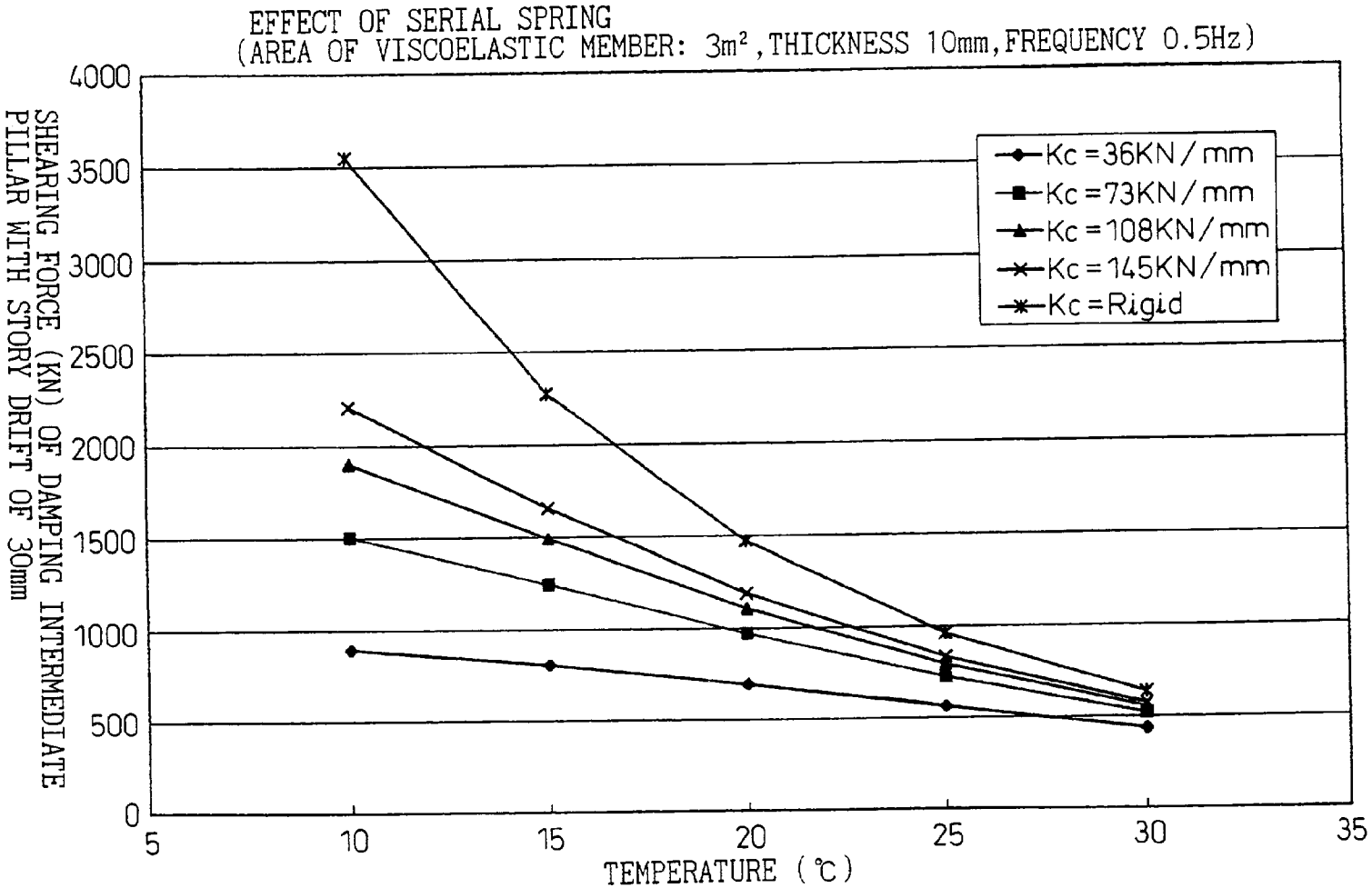
FIG. 20 is a diagram for explaining the relation between the shearing force and the temperature of a damping intermediate pillar according to the invention.
Figure 21:
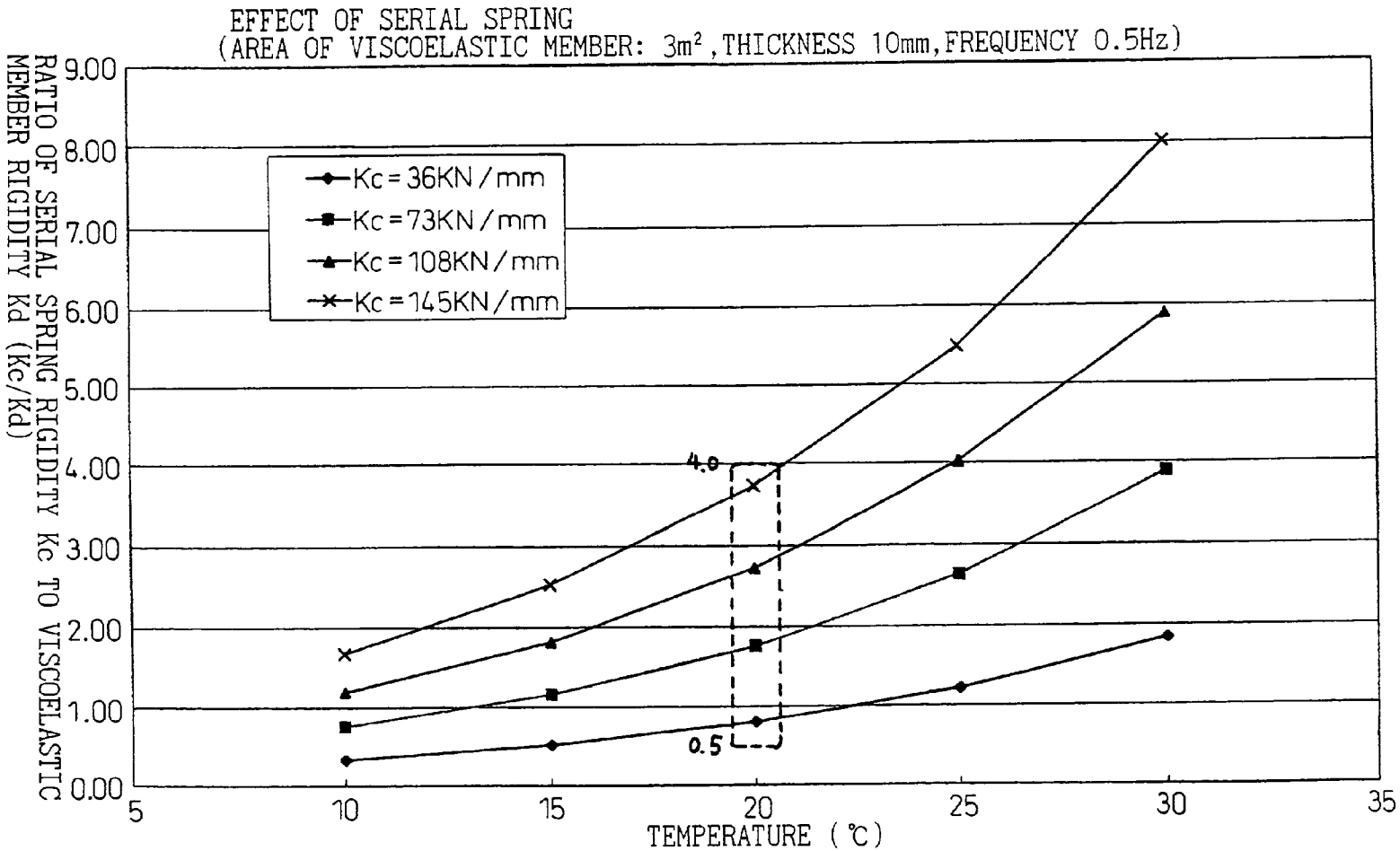
FIG. 21 is a diagram for explaining the relation between the ratio of the rigidity (Kc) to the rigidity (Kd) of the viscoelastic damper and the temperature according to the invention.
Figure 22:
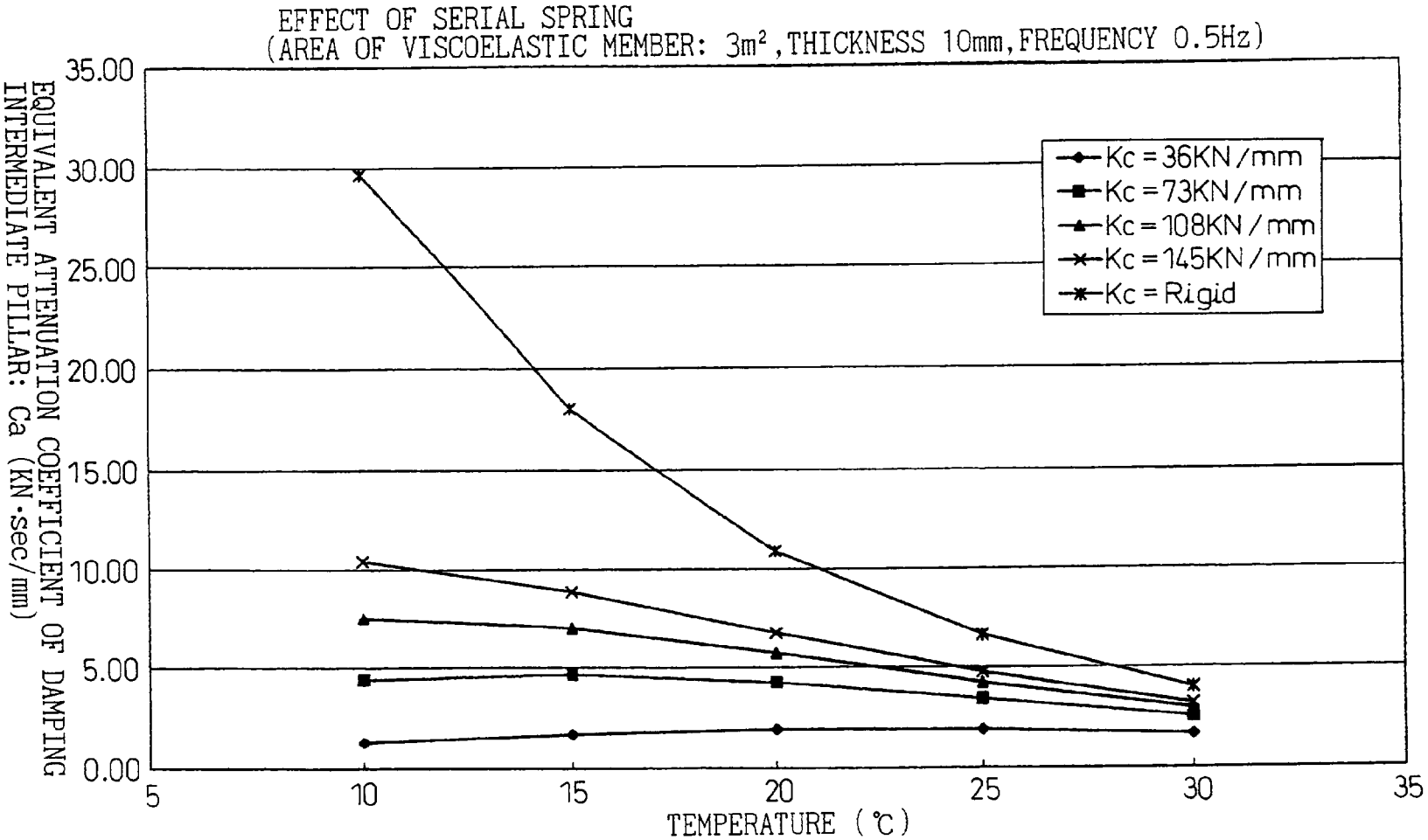
FIG. 22 is a diagram for explaining the relation between the attenuation coefficient of a damping intermediate pillar and the temperature according to the invention.

According to the embodiments of the invention, if an external force of an earthquake or the like having a frequency f of 0.5 Hz has been applied, Kd is the rigidity of the viscoelastic damper (vibration energy absorber) 17, and Kc is the rigidity of the integrated member including the damping intermediate pillar portions 14*a*, 14*b*, the coupling members 13*a*, 13*b*, the beams 3*a*, 3*b* and the knee braces 19 (or the reinforcing ribs 23) coupled in series then FIG. 20 shows the maximum shearing force of the damping intermediate pillar 14 associated with the value Kc/Kd of 0.5 to 4 at the temperature of 20° C. as shown in FIG. 21. FIG. 22 shows the attenuation coefficient of the viscoelastic damper 17 taking into consideration the rigidity of the damping intermediate pillar portions 14*a*, 14*b*, the coupling members 13*a*, 13*b*, the beams 3*a*, 3*b* and the knee braces 19 (or the reinforcing ribs 23).

FIG. 20 shows the shearing force of the damping intermediate pillar 14 with the change in the serial spring rigidity Kc of the serially-connected members. The ratio Kc/Kd for five different serial spring rigidities Kc are shown. They include Kc=Rigid (Kc/Kd=∞), Kc=145 KN/mm (Kc/Kd=3.73), Kc=108 KN/mm (Kc/Kd=2.72), Kc=73 KN/mm (Kc/Kd=1.76) and Kc=36 KN/mm (Kc/Kd=0.8). Kc=Rigid (Kc/Kd=∞) indicates the case in which the serial spring rigidity Kc is very high, and represents the case in which the viscoelastic damper 17 is coupled directly to the pillar-beam joins 2 of the structure. The portions subjected to the inter-layer displacement in FIG. 20 are as shown in FIG. 1. Also, the ratio Kc/Kd is associated with the temperature of 20° C. of the viscoelastic material. FIG. 20 indicates that an increased value of the serial spring rigidity Kc increases the shearing force, i.e. the attenuation effect of the damping intermediate pillar 14. As described above, the attenuation performance of the damping intermediate pillar 14 is considerably affected by the serial spring rigidity Kc. By mounting the knee braces 19 or the reinforcing ribs 23, the serial spring rigidity Kc can be easily improved, thereby effectively producing a higher attenuation performance. Also, since the knee braces 19 or the reinforcing ribs 23 can be mounted very easily, the working procedure is very simple and results in a lower cost.

FIG. 22 shows the attenuation coefficient of the damping intermediate pillar 14 with the change in the serial spring rigidity Kc. It can be seen that an even more effective attenuation performance can be achieved by increasing the serial spring rigidity Kc, as in the case of the shearing force. This can be realized with comparative ease by the provision of the knee braces 19 or the reinforcing ribs 23.

The damping intermediate pillar 14 according to the embodiments of the invention can easily produce a higher attenuation performance in combination with the knee braces 19 or the reinforcing ribs 23. At the same time, the joins between the damping intermediate pillar 14 and the beams 13 are reinforced, thereby realizing an economical damping intermediate pillar 14 which is low in cost.

It will thus be understood from the foregoing description that, according to the invention, the coupling end portions of the damping intermediate pillar are fixed to the beams of the upper and lower floors on the one hand and one or both sides of the damping intermediate pillar are coupled with the upper and lower floor beams using knee braces or reinforcing ribs. As a result, the coupling strength of the joins between the damping intermediate pillar and the beams is improved. Thus, a sufficient strength is exhibited against the horizontal force of a strong earthquake, thereby obviating the problem of the conventional structure in which the joins between the damping intermediate pillar and the beams is broken before the damping function is fully exhibited. Also, the improved serial spring rigidity can produce a larger vibration attenuation ability.

The invention claimed is:

1. A structural frame for a building comprising:

an upper horizontal floor beam and a lower horizontal floor beam located below said upper horizontal floor beam;

a first vertical pillar coupled to said upper horizontal floor beam and said lower horizontal floor beam;

a second vertical pillar horizontally spaced from said first vertical pillar, with said second vertical pillar coupled to said upper horizontal floor beam and said lower horizontal floor beam;

a damping intermediate pillar located between said first vertical pillar and said second vertical pillar, said damping intermediate pillar comprising:

an upper damping intermediate pillar portion of H shape steel directed upward toward said upper horizontal floor beam and a lower damping intermediate pillar portion of H shape steel directed downward toward said lower horizontal floor beam;

a plurality of inner steel plates fixed on one of the damping intermediate pillar portions;

a plurality of outer steel plates fixed on the other damping intermediate pillar portion;

said inner steel plates and said outer steel plates being arranged alternately with each other in a single layer or a plurality of layers, with said inner steel plates and said outer steel plates being parallel to one another;

a viscoelastic member held between the inner and outer steel plates thereby to make up a vibration energy absorbing unit;

a coupling member of H shape steel coupled to each of said upper and lower damping intermediate pillar portions directed upward and downward, respectively, said coupling members being fixed on the upper and lower horizontal floor beams, respectively; and a plurality of knee braces, wherein one or both sides of the coupling members of H shape steel are coupled to the upper and lower horizontal floor beams, respectively, by said knee braces.

2. A structural frame according to claim 1, wherein said knee braces are reinforcing ribs, one side of each of said reinforcing ribs is fixed to a flange of a corresponding one of said coupling members of H shape steel, and the other side of each of said reinforcing ribs is fixed to a corresponding beam flange of the upper and lower horizontal floor beams.

3. A structural frame comprising a plurality of damping intermediate pillars according to claim 1 located between said first vertical pillar and said second vertical pillar.

* * * * *